US005481993A

United States Patent [19]

Kurihara

[11] Patent Number: 5,481,993

[45] Date of Patent: Jan. 9, 1996

[54] METHOD AND APPARATUS FOR EMBROIDERING BEADS

[76] Inventor: Akira Kurihara, 5718 Ravenspur Dr. #101, Rancho Palos Verdes, Calif. 90274

[21] Appl. No.: 157,008

[22] PCT Filed: Sep. 18, 1991

[86] PCT No.: PCT/US91/06792

§ 371 Date: Nov. 30, 1993

§ 102(e) Date: Nov. 30, 1993

[87] PCT Pub. No.: WO93/00468

PCT Pub. Date: Jan. 7, 1993

[30] Foreign Application Priority Data

Jun. 24, 1991 [JP] Japan ..... 3-152031

[51] Int. Cl.[6] ..... D05C 7/08

[52] U.S. Cl. ..... 112/475.01; 112/113; 112/404

[58] Field of Search ..... 112/265.1, 262.2, 112/88, 104, 113, 404, 130, 99, 163

[56] References Cited

U.S. PATENT DOCUMENTS 463,651 11/1891 Taylor .

1,148,694 8/1915 Kursheedt ..... 112/404

1,444,391 2/1923 Rosso ..... 112/404

1,550,778 8/1925 Bretschneider .

3,390,650 7/1968 Ochsner .

4,807,546 2/1989 Lenson et al. .

5,070,799 12/1991 Montgomery et al. ..... 112/130 X 5,315,946 5/1994 Howell ..... 112/265.1

*Primary Examiner*—Peter Nerbun

*Attorney, Agent, or Firm*—Graham & James

[57] ABSTRACT

A method and apparatus for automatically embroidering beads on a cloth is disclosed. A continuous bead string, which is made of a plurality of beads with separable connecting sections arranged in the direction of an axial bore in the beads of the bead string, is utilized. The apparatus sets the continuous bead string on the cloth. The bead at the end of the bead string is bent and separated at the connecting section. A needle passes through the axial bores of the beads so that the beads are separated from the bead string and sewed onto the cloth.

14 Claims, 25 Drawing Sheets

FIG. 3(a)
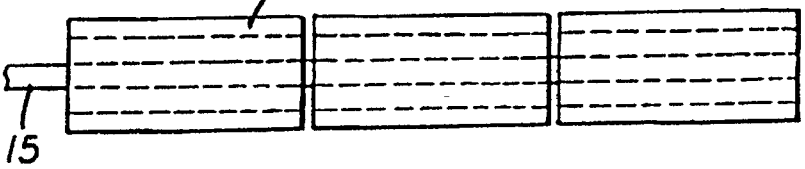
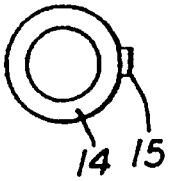
FIG. 3(c)
FIG. 3(b)
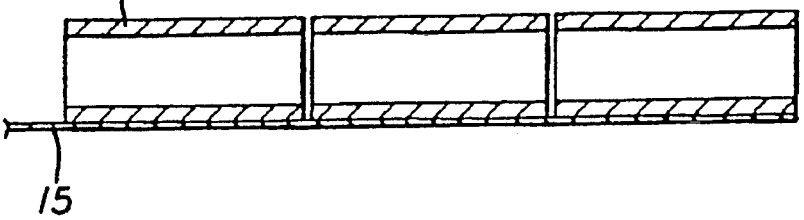
FIG. 4(a)
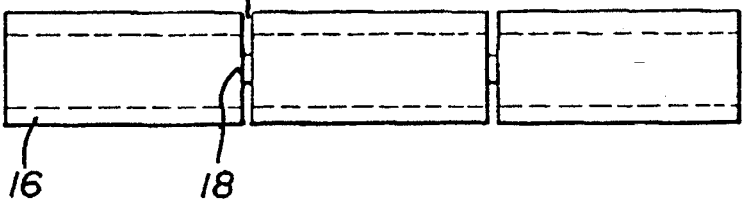
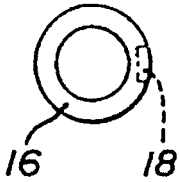
FIG. 4(c)
FIG. 4(b)
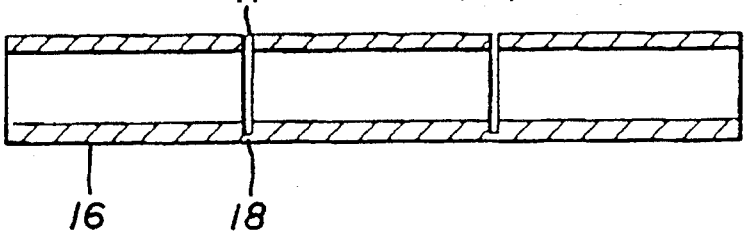

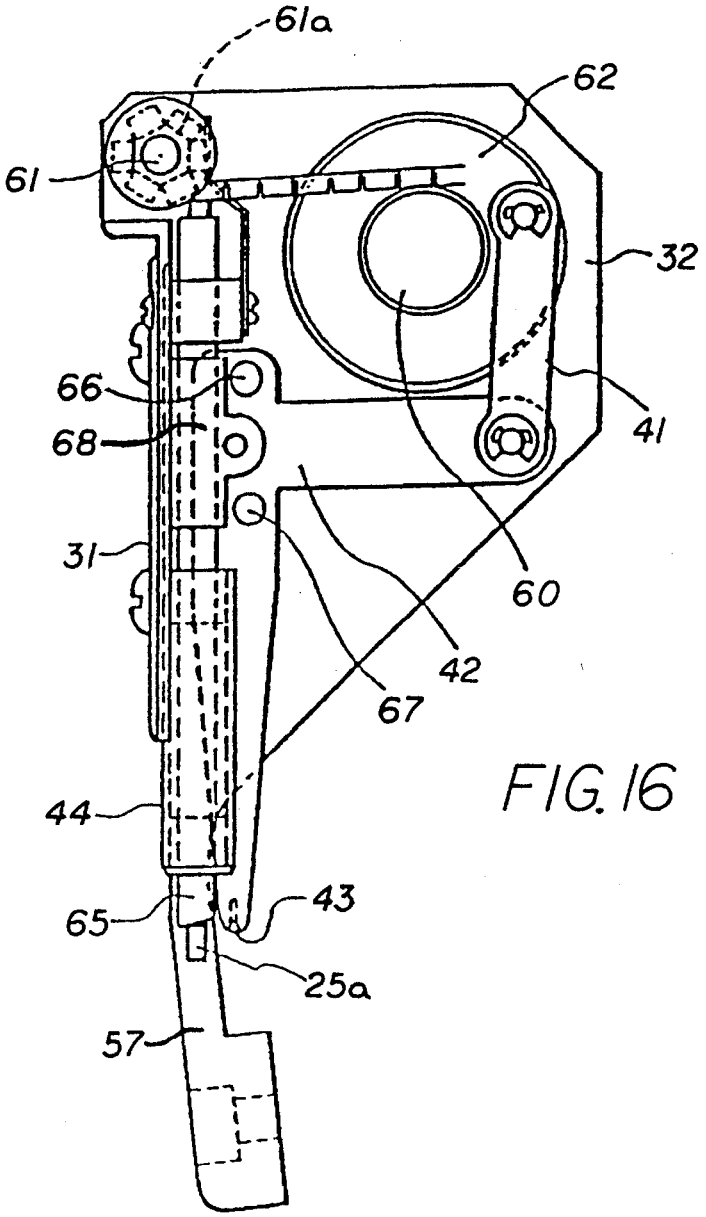
FIG. 16
FIG. 17
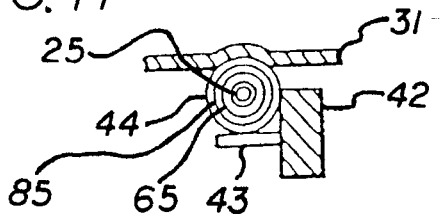

FIG. 18
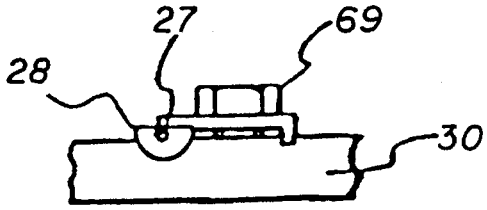
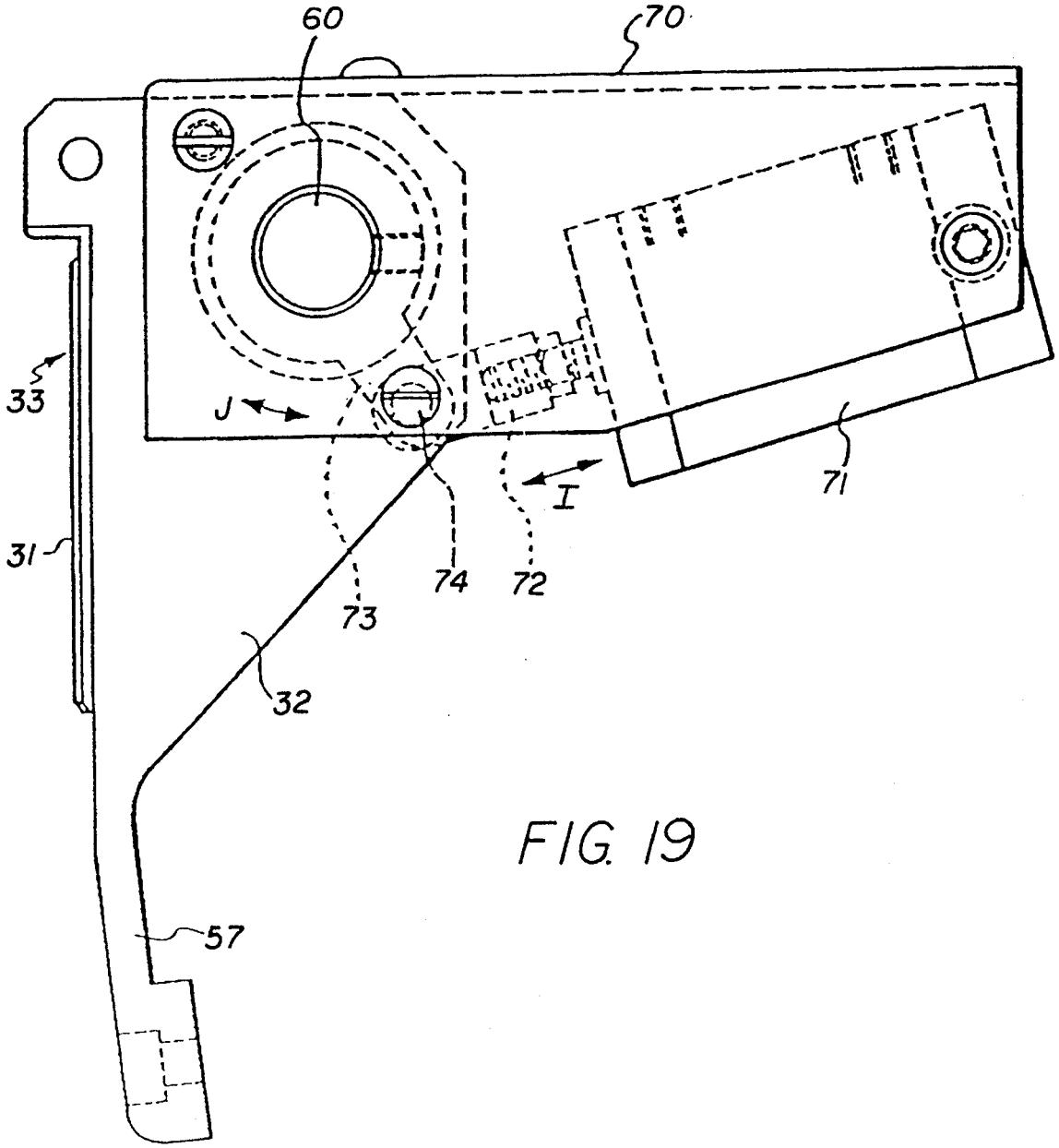
FIG. 19

METHOD AND APPARATUS FOR EMBROIDERING BEADS

BACKGROUND OF THE INVENTION

The present invention relates to an automatic bead embroidering method which makes it possible to sew beads to a cloth by the use of an embroidering apparatus that is used for embroidery on cloth, and to an apparatus which is used together with the embroidering apparatus in order to perform the method.

Conventionally, decorative beads are made from materials such as glass, ceramics, metals, and plastics. Such beads are embroidered on cloth, as ornamentation for clothing. In such an embroidery, the beads are sewn to the cloth one by one using hand embroidering needles.

Meanwhile, in regard to clothing ornamentation other than beads, a method in which flat plate-form ornaments are sewn onto cloth is disclosed in Japanese Patent Application Publication No. 46-16985 (U.S. Pat. No. 3,390,650). In this method, flat plate-form ornaments are sewn onto the cloth, and the disclosure does not address cylindrical objects such as beads which cannot be embroidered.

Furthermore, multi-head type embroidering machines which perform embroidery by causing needles to perform a reciprocating motion perpendicular to a cloth, and shuttle type embroidering machines with a size of 15 yards or greater (formed by scaling up the multi-head type embroidering machines) have been in a practical use and are thus well known (U.S. Pat. Nos. 2,030,495 and 3,062,163).

In the case of bead embroidering methods using conventional hand sewing techniques, considerable time and labor are required. Thus, the productivity of such a method is extremely low. This delays the finishing of bead-embroidered products such as clothing, so that there are problems in terms of late delivery dates. Such late delivery dates are an extremely serious problem in the clothing industry, which is subject to abrupt changes in fashion.

Furthermore, in the case of bead embroidering methods using hand sewing techniques, the quality and pattern of the embroidery are not uniform, and the reliability of the sewn attachments is poor. Embroidering threads on which beads are sewn may become slack, or may break so that multiple numbers of beads are lost. As a result, there are problems in terms of product quality.

Furthermore, since the conventional embroidering machines perform embroidery using embroidering threads with attached beads, the bead embroidering process itself cannot be automated.

SUMMARY OF THE INVENTION

In light of the prior art described above, the present invention provides a method and apparatus for embroidering beads which makes it possible to automate the embroidering of beads on a cloth by linking a conventional embroidering apparatus to a bead embroidering mechanism. The present invention employs a method for embroidering bead wherein needles which perform a reciprocating motion relative to the surface of a cloth are used to affix a bead severed from a continuous bead string to the cloth. The beads are provided to in a continuous bead string by connecting multiple numbers of beads via easily separable connecting sections. The respective individual beads of each of the continuous bead string include an axial bore therethrough, and the connecting sections are formed to arrange the beads in a virtually linear arrangement along the direction of the axial bore of the beads.

BRIEF DESCRIPTION OF THE DRAWINGS

FIGS. 3(*1*), 3(*b*) and 3(*c*) are top, cross sectional and front views, respectively, of the bead string shown in FIGS. 2(*a*);

FIGS. 4(*a*), 4(*b*) and 4(*c*) are top, cross sectional and front views, respectively, of the bead string shown in FIB. 2(*b*);

FIG. 16 is a side view thereof;

FIG. 17 is a cross section taken along the line 17—17 in FIG. 14;

FIG. 18 is a front view of a portion of the needle bar used in the embroidering apparatus to which the present invention is applied;

FIG. 19 is a side view of the driving mechanism of the apparatus shown in FIG. 14.

DETAILED DESCRIPTION OF THE INVENTION

Figure 1:
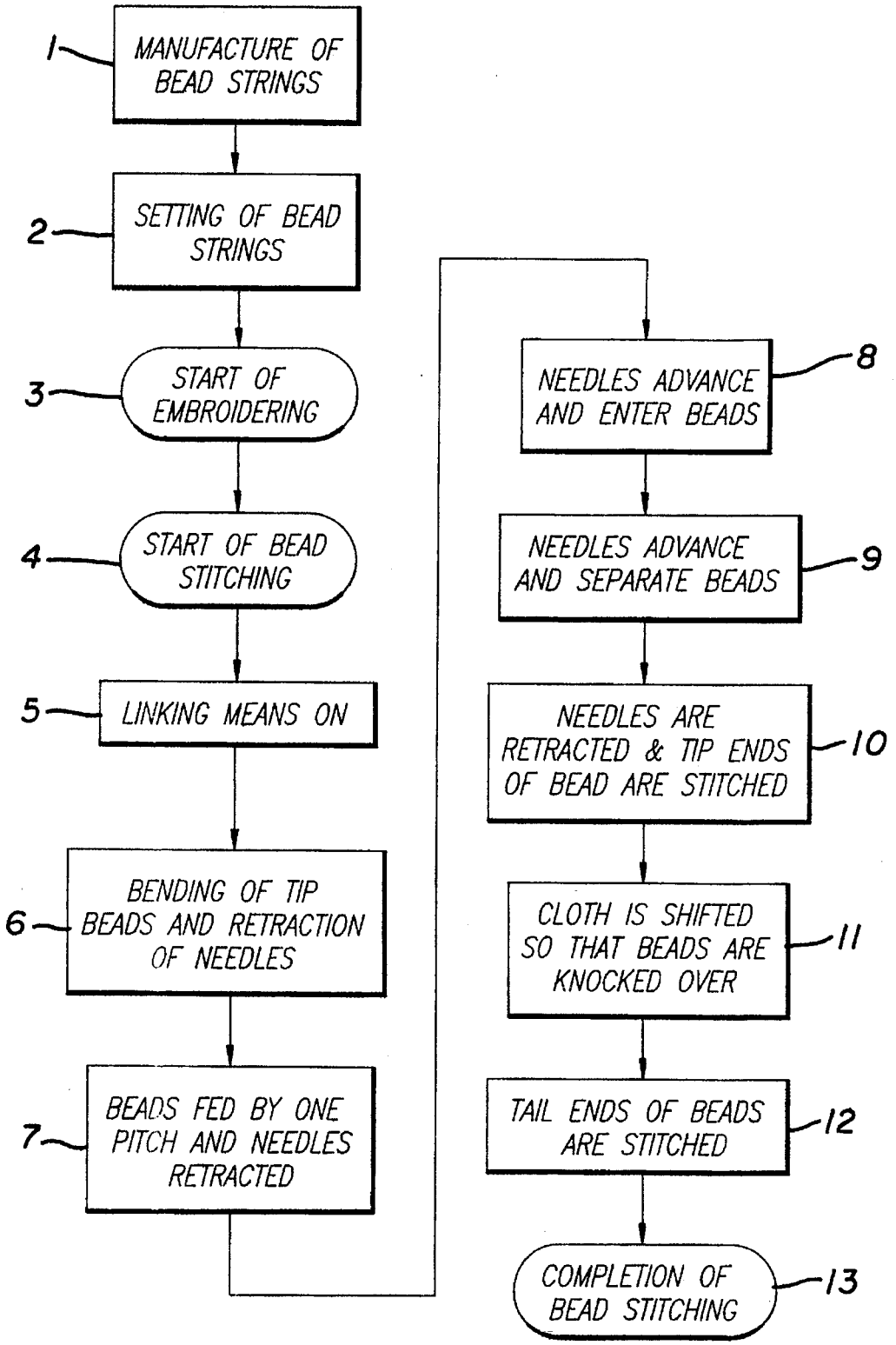
FIG. 1 is a flow chart of the operation of the method of the present invention.
Figure 2A:
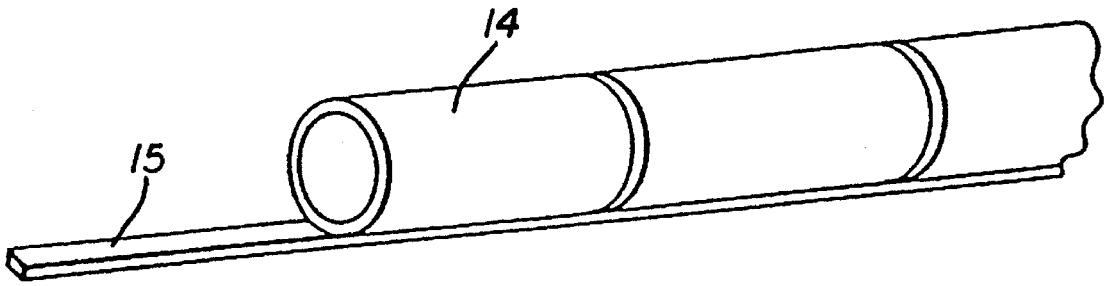
FIGS. 2(*a*), 2(*b*) and 2(*c*) are perspective views illustrating different bead strings which are used in the present invention.
Figure 2B:
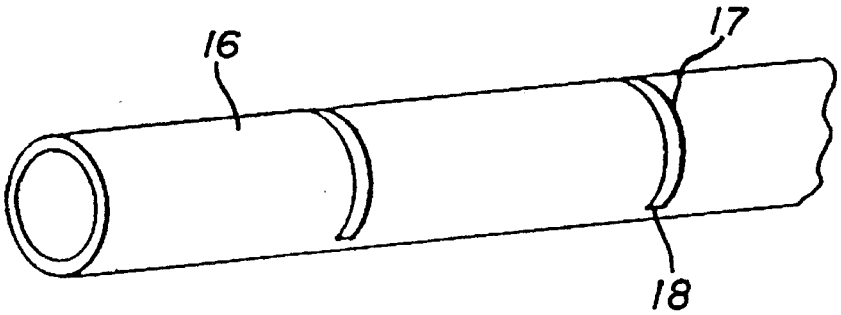
Figure 2C:
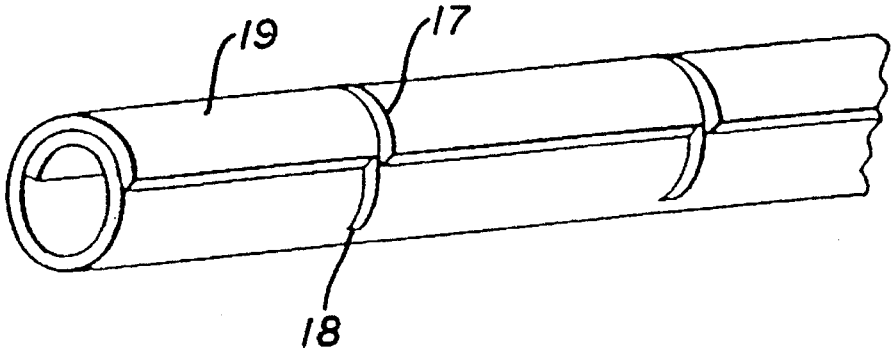
Figure 5A:
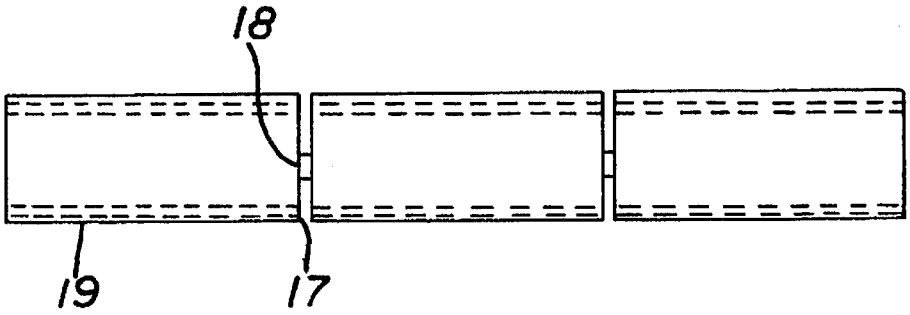
FIGS. 5(*a*), 5(*b*) and 5(*c*) are top, cross sectional and front views, respectively, of the bead string shown in FIG. 2(*c*)
Figure 5B:
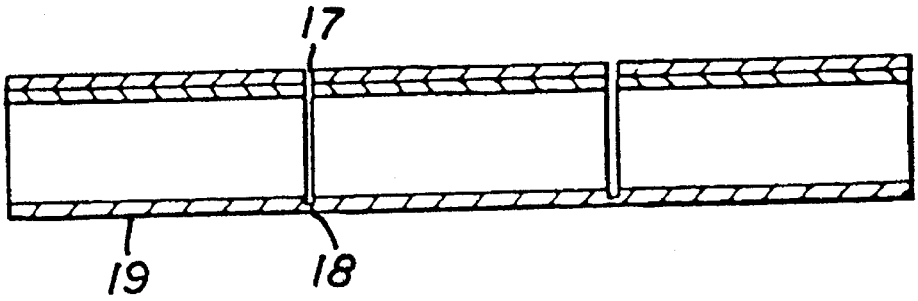
Figure 5C:
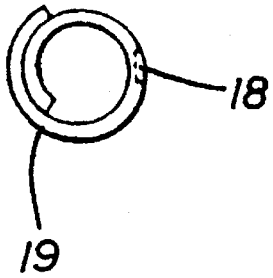

FIG. 1 shows a flow chart of the method of the present invention. First, in Step 1, continuous bead strings used in the present invention are prepared. Examples of the continuous bead strings used in the bead embroidering method of the present invention are shown in FIGS. 2(*a*), 2(*b*), and 2(*c*), Cylindrical beads are depicted as examples. A top view, longitudinal section, and front view of each of the examples shown in FIGS. 2(*a*), 2(*b*) and 2(*c*) is shown in FIGS. 3, 4 and 5(*a*), 5(*b*) and 5(*c*), respectively. Moreover, in regard to the bead shape, the present invention is not limited to the cylindrical shapes shown in the drawings it being understood that the invention is also applicable to other bead shapes which include an axial bore including; beads with circular and angular cross sections including: (hexagonal, square and other polygonal shapes).

In the example shown in FIG. 2(*a*), a multiple number of glass beads 14 which have been cut beforehand into separate cylinders are bonded in a continuous line to a slender transparent tape 15, e.g., consisting of an acetate film with a width of 1 mm, by means of an adhesive. The respective beads are connected to each other via the tape 15. This tape 15 has an adhesive strength which allows for easy separating during the bead embroidering operation.

In the example shown in FIG. 2(*b*), individual beads 16 are formed by way of cut-outs 17 (e.g., at 4-millimeter intervals) in a slender tube (consisting of plastic, etc.) with an external diameter of 2.5 to 3 mm and an internal diameter of 1.5 to 2 mm. These cut-outs 17 are formed in a cross-sectional direction by means of a cutter, with a portion of the tube left in each cut-out as a connecting section 18. Like the tape 15, these connecting sections 18 have a connecting strength that allows for easy separation during the bead embroidering operation.

In the example shown in FIG. 2(*c*), a belt is formed into a tube by bending, and individual beads 19 are formed by forming cut-outs 17 in the tube with connecting sections 18 left intact as in the same manner as in the example illustrated in FIG. 2(*b*). These connecting sections 18 have a strength which allows for easy separation during the bead embroidering operation.

Figure 6:
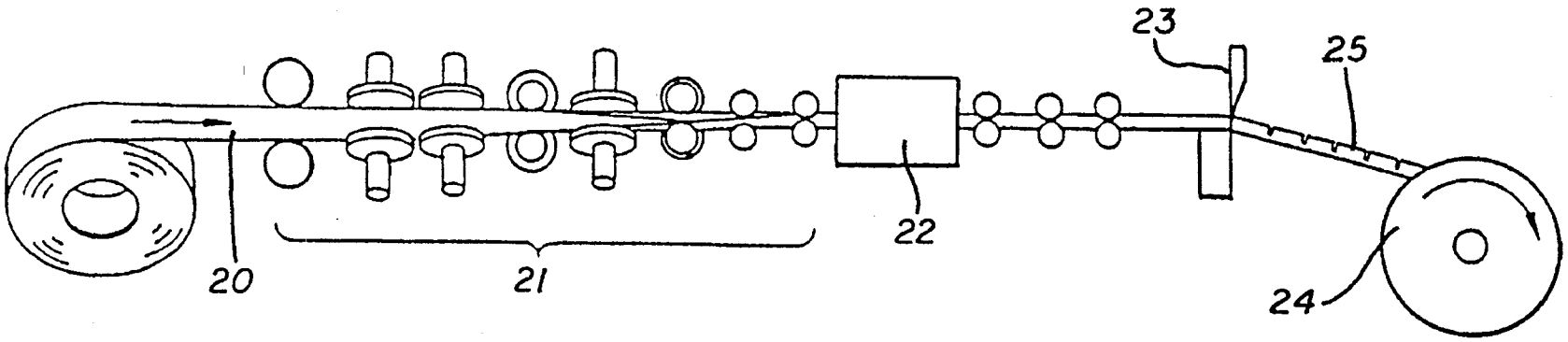
FIG. 6 is an explanatory diagram showing an example of a method of manufacturing the bead string shown in FIG. 2(*c*)
Figure 7A:
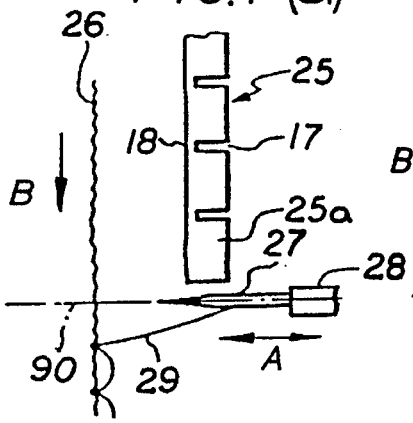
FIGS. 7(*a*) through 7(*h*) are process diagrams showing the steps of the method of the present invention in sequence.
Figure 7B:
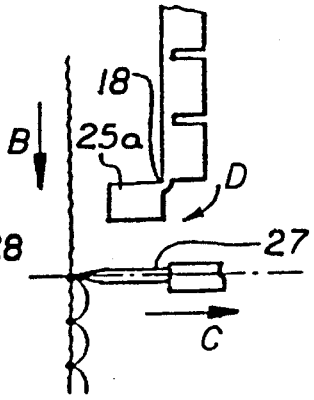
Figure 7C:
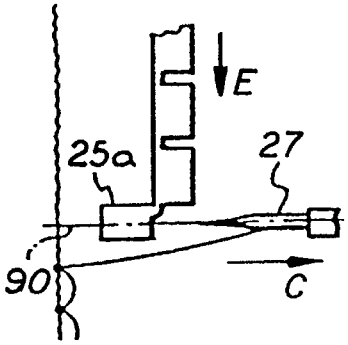
Figure 7D:
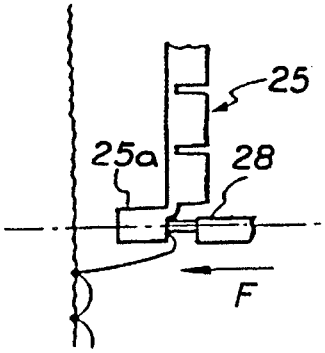
Figure 7E:
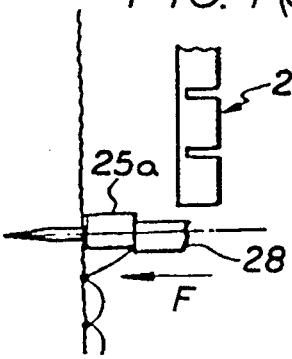
Figure 7F:
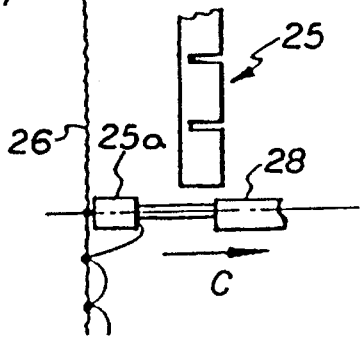
Figure 7G:
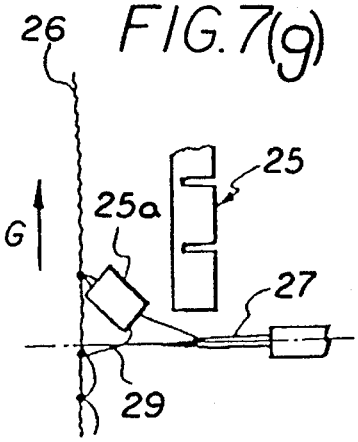
Figure 7H:
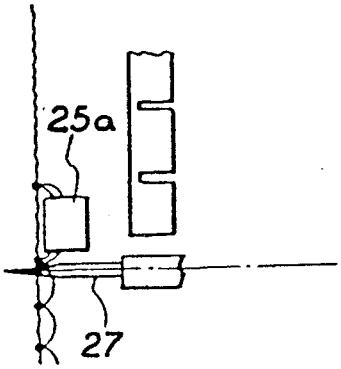

FIG. 6 shows one example of a method which can be used to manufacture a continuous bead string of the type shown in FIG. 2(*c*). A tape 20, for example a polyester film, which can withstand relatively high temperatures but also possesses thermoplasticity, is fed out from a roll and is formed into a long, slender tube with an external diameter of approximately 2.5 mm and an internal diameter of approximately 2 mm by means of forming rollers 21. This shape is fixed by means of a heater 22. The cut-outs 17 are formed in this tube material by means of a cutter 23. As a result, a continuous bead string 25 is formed, and this continuous bead string 25 is taken up on a reel 24. In cases where a bead string is manufactured by the forming and working of such a plastic film, various types of printing (using heat transfer printing, etc.) and finishing (using vacuum evaporation of aluminum, etc.) may be performed on the film before it is formed into a tube. Furthermore, various types of films can be manufactured relatively easily by lamination, and bead strings of various colors can be manufactured using these films.

The connecting sections 13 of the bead strings are formed in a generally linear arrangement aligned with the direction of the axis of the axial bore of each bead. The reason for this is that it is necessary to bend each bead in a fixed direction, as will be described below. Accordingly, as long as each bead can be sent in a substantially fixed direction, it is not strictly necessary for the connecting sections 18 to be located on a straight line.

Returning to FIG. 1, in Step 2, the continuous bead strings are set in an embroidering apparatus which is itself a universally known type of apparatus. In this case, as will be described in concrete terms below, the bead embroidering mechanism or apparatus of the present invention is mounted beforehand on a universally known embroidering apparatus, and the continuous bead strings are set as described below in the bead embroidering apparatus of the present invention. FIG. 7(*a*) illustrates one of the continuous bead strings 25 in its set state. Each bead string 25 is preferably set so that its connecting sections 18 face toward the cloth 26 that is to be embroidered. Each needle 27 in the embroidering apparatus performs a reciprocating motion, together with a corresponding shoulder or pushing part 28 which will be described later, in a direction preferably perpendicular to the cloth 26.

In Step 3, when the setting of the continuous bead strings is completed, the embroidering apparatus is driven so that the embroidering operation is initiated. Each needle 27 performs a reciprocating motion as indicated by arrow A in FIG. 7(*a*), so that an embroidering thread 29 is stitched to the cloth 26. The cloth 26 is moved in accordance with the direction of embroidering, as shown by arrow B, relative to the reciprocating path 90 of each needle 27. Here, assuming that the embroidering thread 29 of each needle 27 is a surface-thread with respect to the cloth 26, the back thread on the opposite side of the cloth 26 is not shown in the drawings.

Next, in Step 4, bead embroidering is started in accordance with a command to initiate bead stitching. As a result in, in Step 5, a linking means which links the bead embroidering mechanism with the driving mechanism or mechanisms of the needles 27 is actuated so that beads are embroidered by the action of the needles 27 as will be described later.

First, in Step 6 and in accordance with the withdrawing action of each needle 27, indicated by arrow C in FIG. 7(*b*), tip bead 25*a* of each bead string 25 is bent as indicated by arrow D. In this case, the tip bead 25*a* is bent about the corresponding connecting section 18 so that the bead 25*a* is oriented perpendicular to the cloth 26. This is done in order to open the rear end of the bead so that the needle 27 can be inserted into the axial bore of bead. Accordingly, as long as an opening which is sufficient to guide the needle 27 into the bead is formed, it is not absolutely necessary that the bead be bent into a perpendicular position.

In linkage with the withdrawing motion of each needle 27, in Step 7, each bead string 25 is fed by one pitch (the length of one bead) toward the reciprocating path 90 of the corresponding needle 27 as shown by arrow E in FIG. 7(*c*). As a result, the tip bead 25*a* of each bead string 25 is positioned in the reciprocating path 90 of the corresponding needle 27. The bending action of Step 6 and the feeding action of Step 7 are both performed in linkage with the withdrawing motion of each needle 27, as will be described later; however, the order of these actions may be reversed.

Next, in Step 8, each needle 27 advances as indicated by arrow F in FIG. 7(*d*) and enters the corresponding tip bead 25*a*.

Furthermore, in Step 9, as each needle 27 advances, the corresponding tip bead 25*a* is separated from the continuous bead string 25 by the corresponding pushing part 28 as shown in FIG. 7(*e*).

Next, in Step 10, the needle 27 withdraws, and the tip end of the tip bead 25*a* is stitched to the cloth 26 as shown in FIG. 7(*f*).

Next, in Step 11, the cloth 26 is moved in the direction indicated by arrow G in FIG. 7(*b*), i.e., in such a direction that the needle 27 is caused to return to a previous position. As a result, the bead 25*a* is caused to fall over by the thread 29 as shown in FIG. 7(*g*).

With the bead 25*a* fallen over, in Step 12, the needle 27 makes one reciprocating motion as shown in FIG. 7(*h*), sewing the tail end of the bead 25*a*. In Step 13, sewing action on one bead is thus finished.

Next, a concrete embodiment of the bead embroidering apparatus which is mounted on the universally known embroidering apparatus in order to perform the bead embroidering operation will be described with reference to the subsequent figures.

Figure 8:
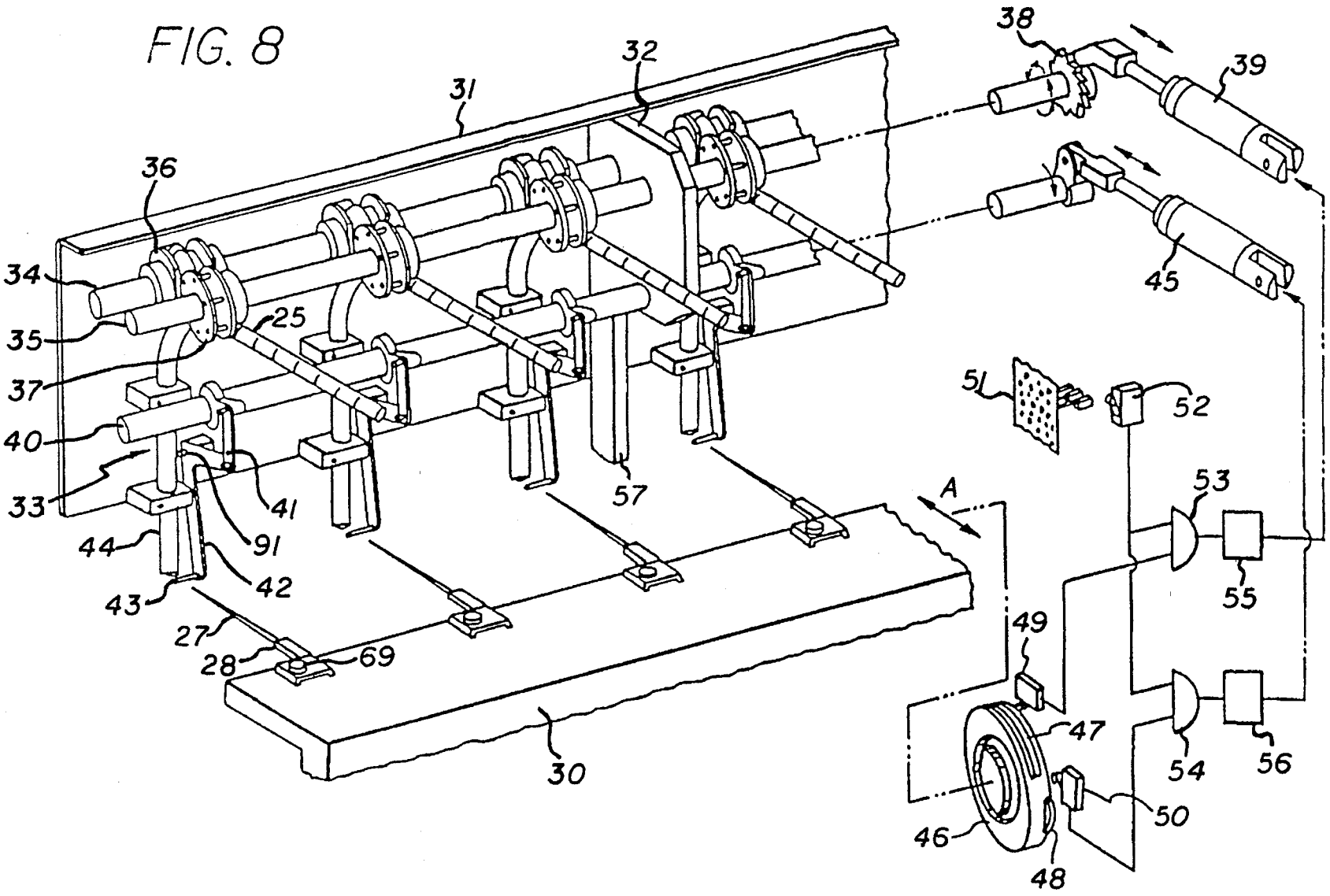
FIG. 8 is an illustration showing one embodiment of the bead embroidering apparatus of the present invention.

FIG. 8 illustrates the structure of one embodiment of the bead embroidering apparatus of the present invention. A universally known shuttle type embroidering apparatus is equipped with a needle bar 30. A multiple number of needles 27 are fastened together with corresponding pushing parts 28 to the needle bar 30 at prescribed intervals via bolts 69. Bead embroidering mechanisms 33 constructed according to the present invention are installed at positions corresponding to the needles 27. These bead embroidering mechanisms 33 are fastened to the static part (not shown in the figures) of the embroidering apparatus via the fastening member 57 of the brackets 32 that are installed at prescribed intervals on a plate 31. Guide pipes 44 which guide bead strings 25 to the respective needles 27 are fastened to the plate 31. Three shafts, i.e., first, second and third shafts 34, 35 and 40, are mounted to the brackets 32. Hexagonal rollers 36 are rotatably mounted on the first shaft 34. The bead strings 24 are carried around these hexagonal rollers 36 so that the cut-outs 17 (see FIG. 2) are opened up. Bead-feeding sprocket wheels 37 are mounted on a second shaft 35. This shaft 35 is connected to an air cylinder 39 via a ratchet 38, so that the shaft 35 is intermittently driven by a prescribed pitch in one direction.

Levers 42 are connected to the third shaft 40 via links 41. These levers 42 are installed so that they can rotate about supporting points 91 which are fastened to the plate 31. Furthermore, a pin 43 is installed at the tip end of each lever 42. The shaft 40 is connected to an air cylinder 45, so that the shaft 40 is caused to perform a reciprocating rotary motion.

Reference numeral 51 is a jacquard punch tape used in the embroidering apparatus. The horizontal and vertical movements, i.e., movements in the X and Y directions, of the cloth frame (not shown), on which the cloth that is to be embroidered is installed, are controlled by the hole program data of the tape 1, so that a desired embroidery pattern is automatically stitched. A bead embroidering "start" command is programmed, by punching, into this punch tape 51. The reciprocating motion, indicated by arrow A, of the needle bar 30 on which the needles 27 are installed is controlled by a cam 46. Timing projections 47 and 48 are formed on this cam 46, and switches 49 and 50 are provided so as to face the projections. As a result of this construction, the respective switches 49 and 50 are actuated for desired time periods by the timing of the reciprocating motion of the needles 27.

The bead embroidering "start" command punched into the punch tape 51 is detected by a switch 52. When this command is detected, the outputs of the switches 49 and 50 are sent to the driving circuits 55 and 56 of the air cylinders 39 and 45 via AND circuits 53 and 54. As a result, the respective shaft 35 and 40 of the bead embroidering mechanisms 33 are rotated in linkage with the needles 27.

Figure 9:
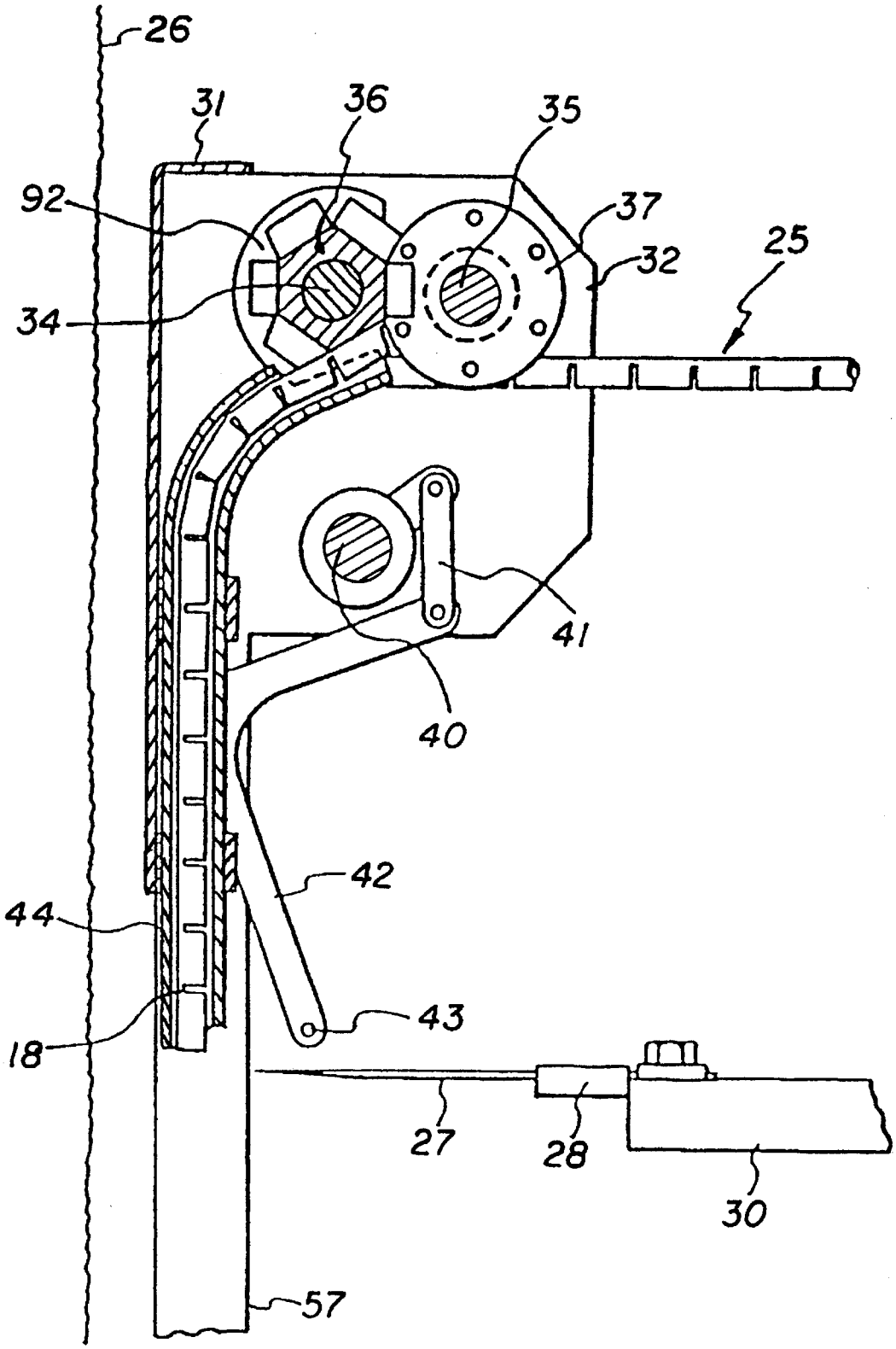
FIG. 9 shows a step of the operation of the embroidering apparatus shown in FIG. 8.

The operation of the embodiment described above is illustrated in sequence in FIGS. 9 through 13. FIG. 9 shows the state in which the bead strings 24 are set prior to the initiation of the bead embroidering operation. Each bead string 25 is carried around one of the hexagonal rollers 36 so that the spaces between the beads are enlarged. The respective pins of the adjacent sprocket wheel 37 come into the respective space 92. Each bead string 25 is then guided into the corresponding guide pipe 44 with the connecting sections 18 of the bead string 25 facing toward the cloth 26. Thus, the cloth 26 is ready to be embroidered by the reciprocating action of the needle bar 30.

Figure 10:
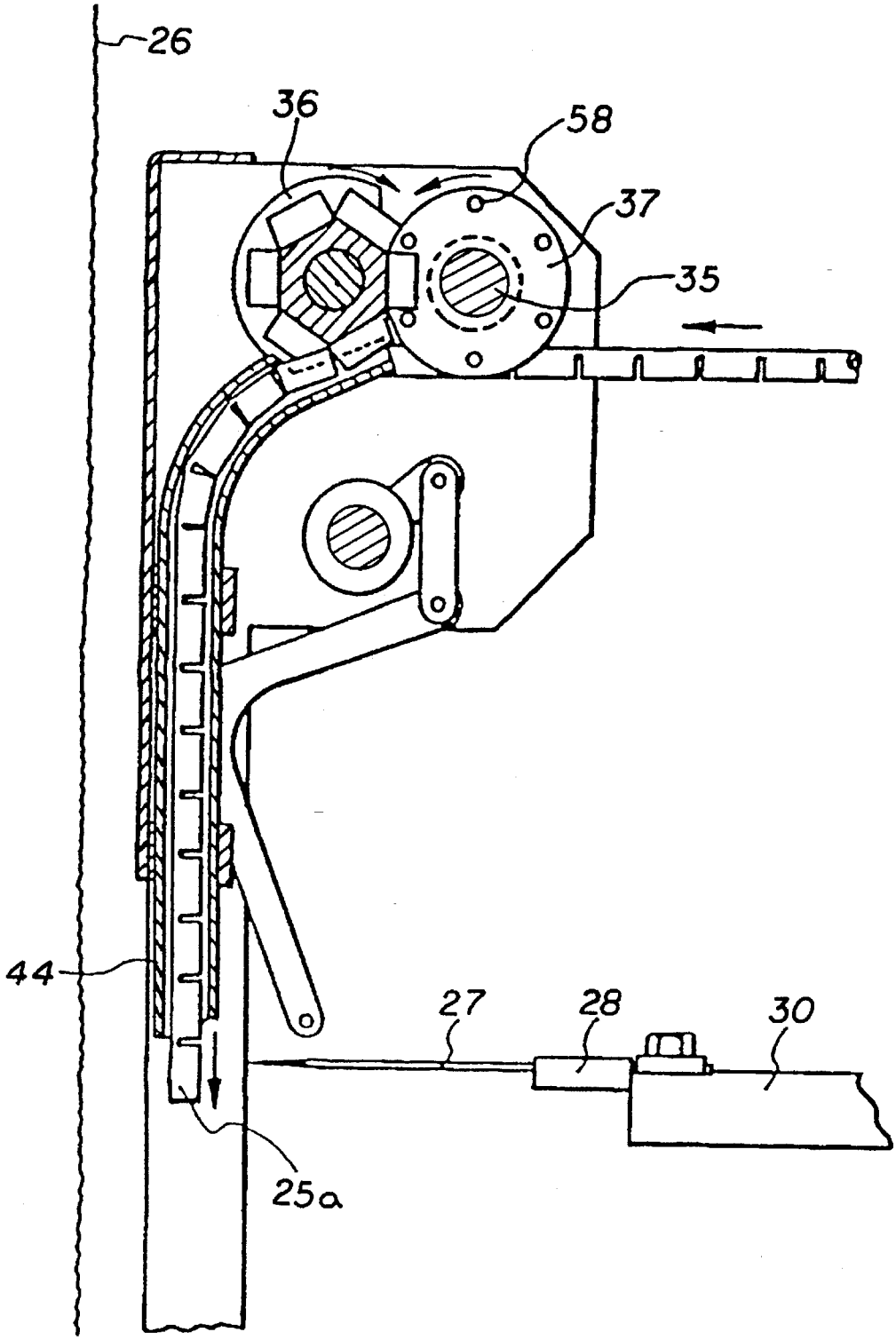
FIG. 10 shows the next step thereof.

When the bead embroidering "start" command of the punch tape 51 is detected, the shaft 35 rotates by one pitch as shown in FIG. 10. As a result, the sprocket wheel 37 is caused to rotate, so that each bead string 25 is fed out by one pitch. Accordingly, the tip bead 25*a* of the bead string 25 protrudes from the tip of the guide pipe 44 and moves into the reciprocating path 90 of the corresponding needle 27.

Figure 11:
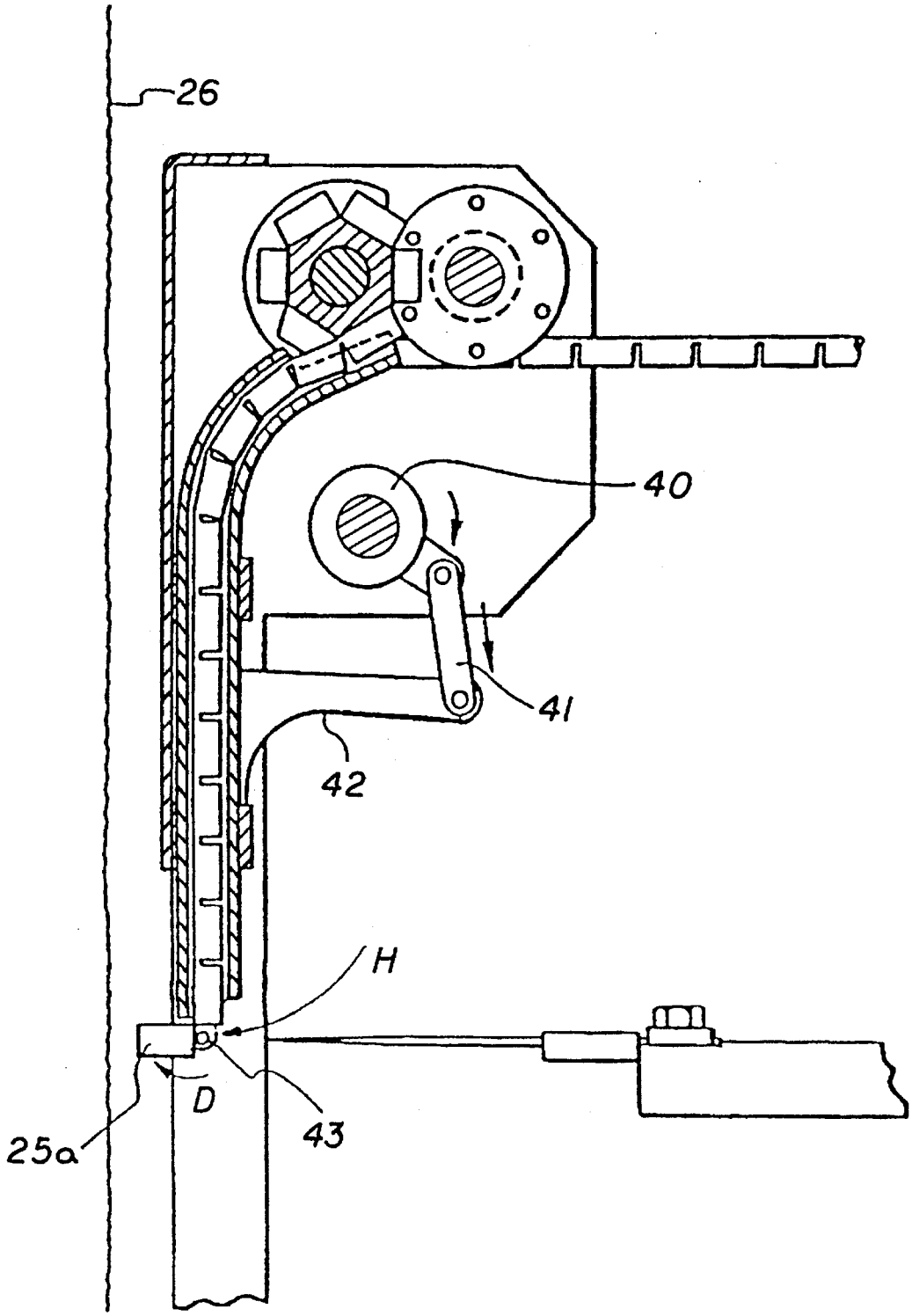
FIG. 11 shows the next, next step thereof.

Next, as shown in FIG. 11, the shaft 40 is driven so that the lever 42 is rotated via the link 41 in the direction indicated by arrow H. As a result, the tip-end pin 43 on the lever 42 presses against the tip bead 25*a*, and bends the bead 25*a* as indicated by arrow D.

Figure 12:
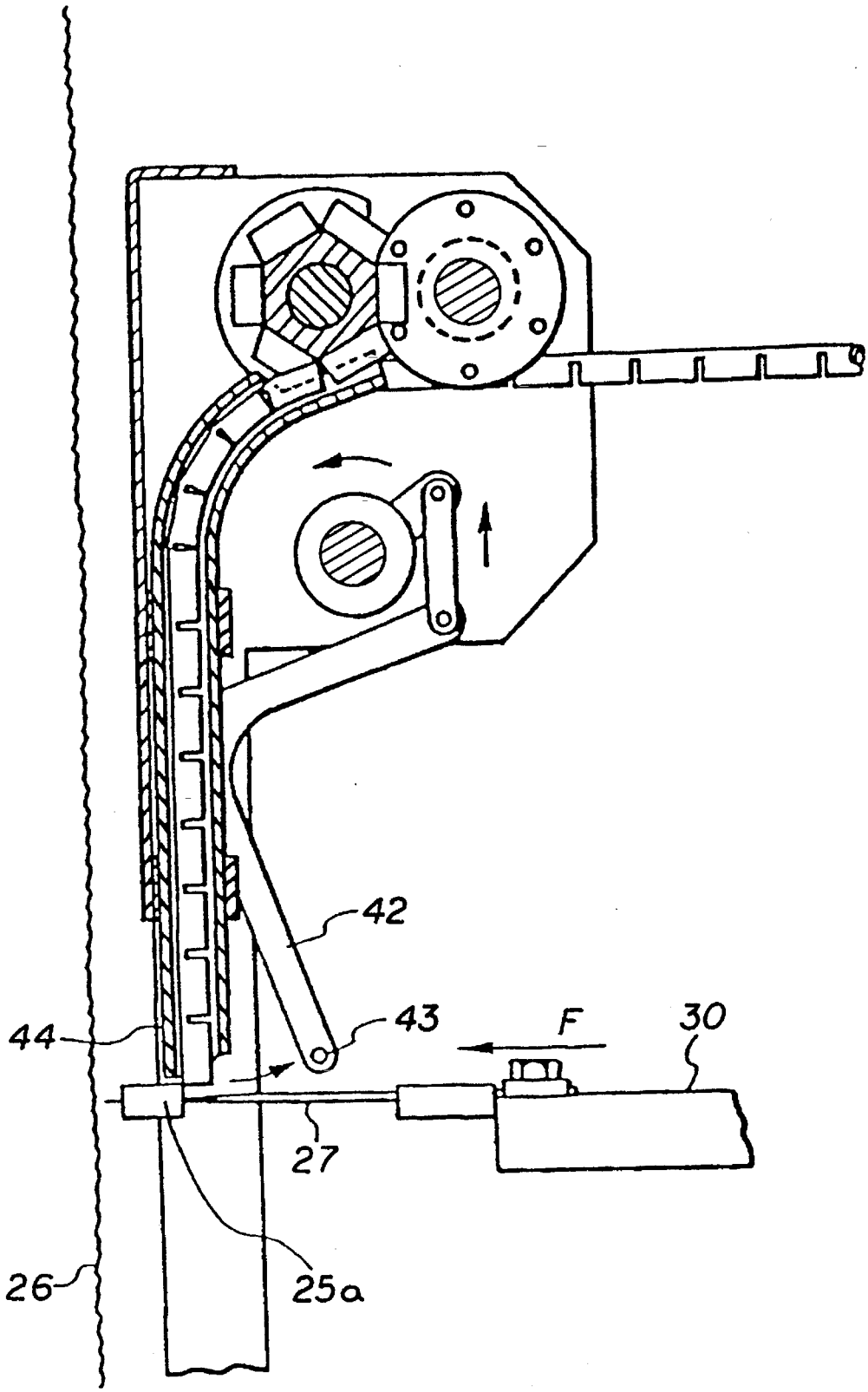
FIG. 12 shows the further step thereof.

Next, as shown in FIG. 12, the needle 27 advances and enters the tip bead 25*a*. At the same time, the lever 42 rotate in a reverse direction so that the pin 43 moves away from the guide pipe 44.

Figure 13:
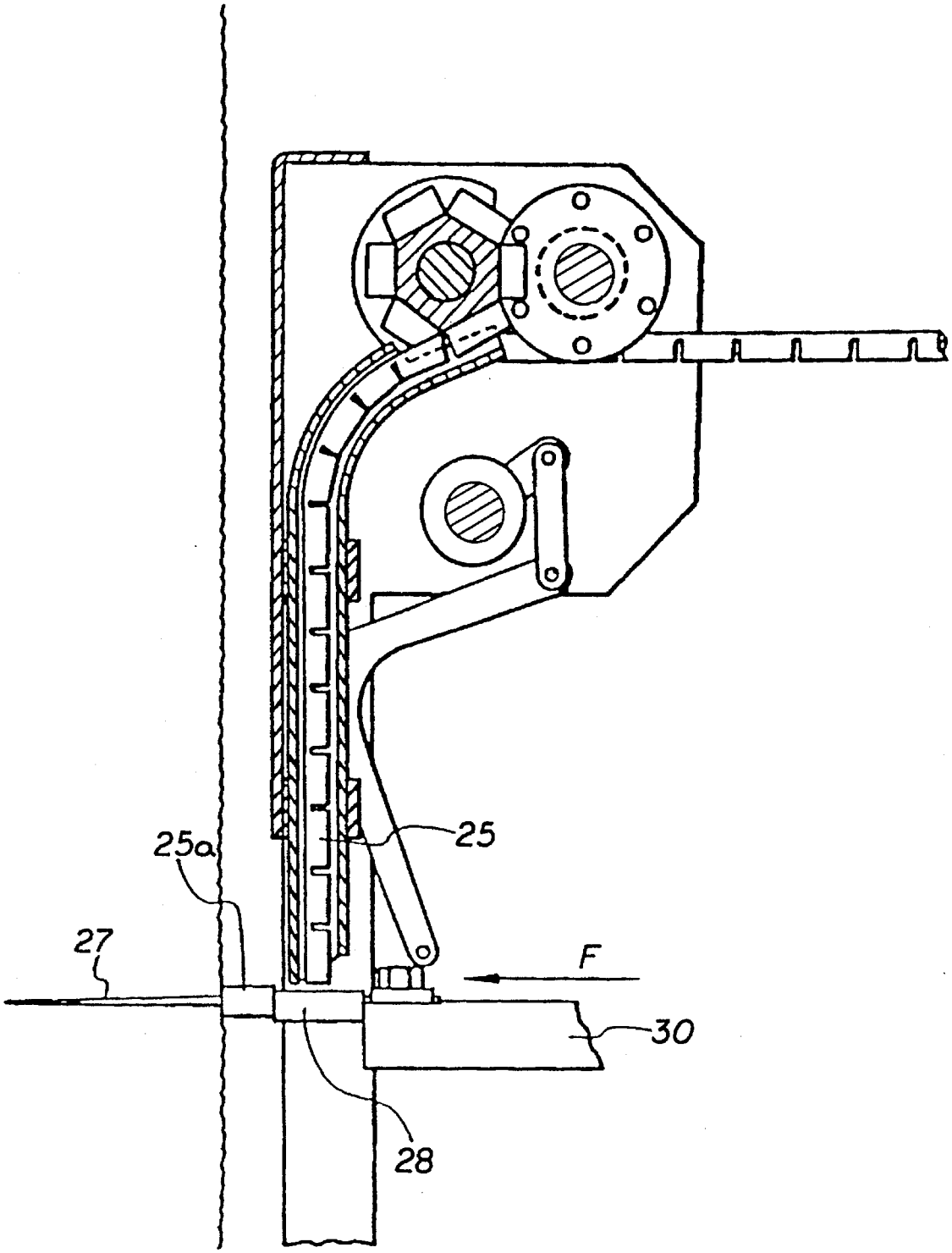
FIG. 13 shows the still further step thereof.

Furthermore, by the advancing motion of the needle bar 30 as shown by arrow F, the pushing part 28 comes into contact with the tip bead 25*a* and separates the tip bead 25*a* from the bead string 25 as shown in FIG. 13. Subsequent operations are performed as illustrated in FIGS. 7(*f*) through 7(*h*).

Figure 14:
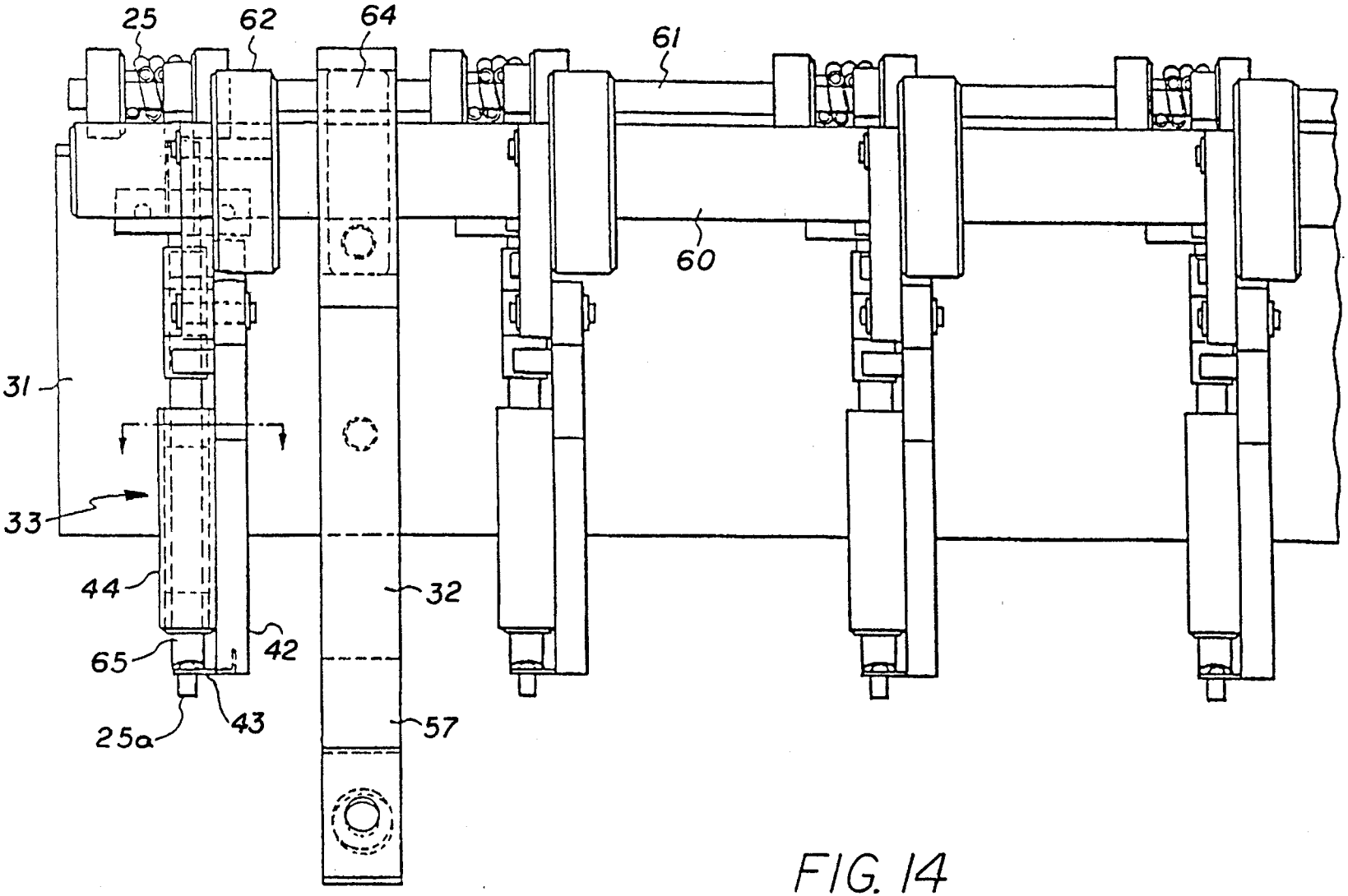
FIG. 14 is a front view of a second embodiment of the bead embroidering apparatus of the present invention.
Figure 15:
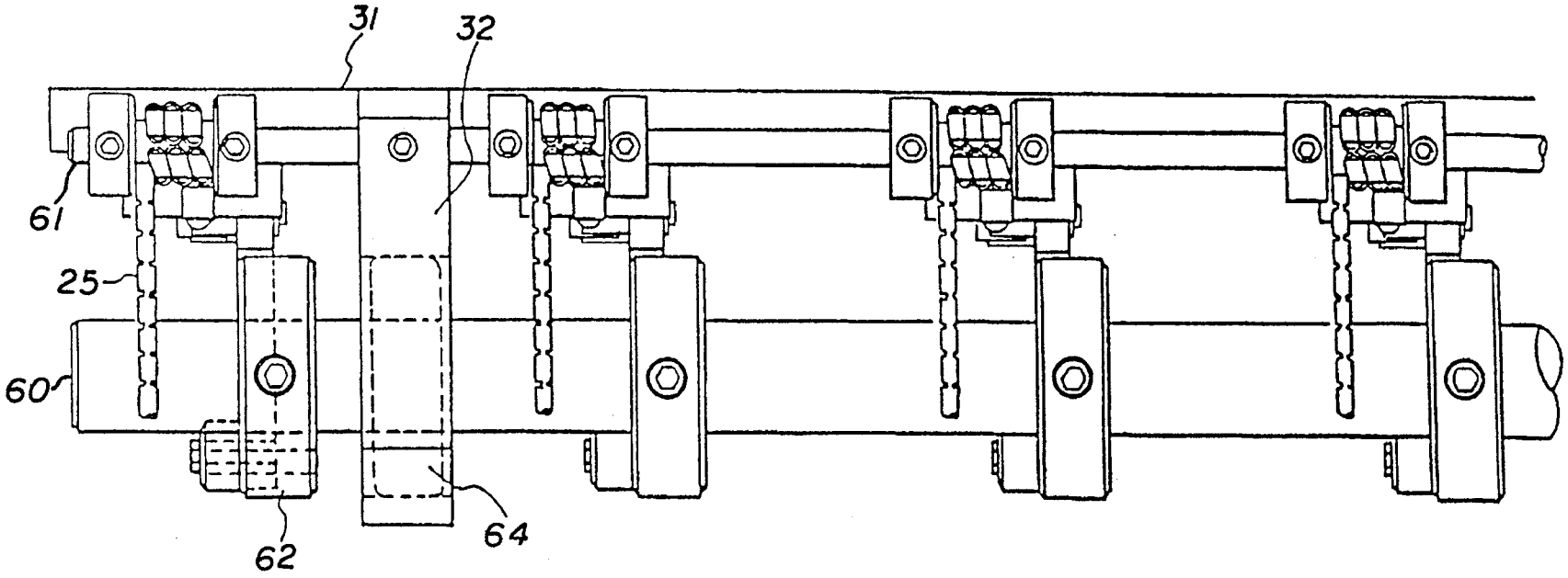
FIG. 15 is a top view thereof.
Figure 22:
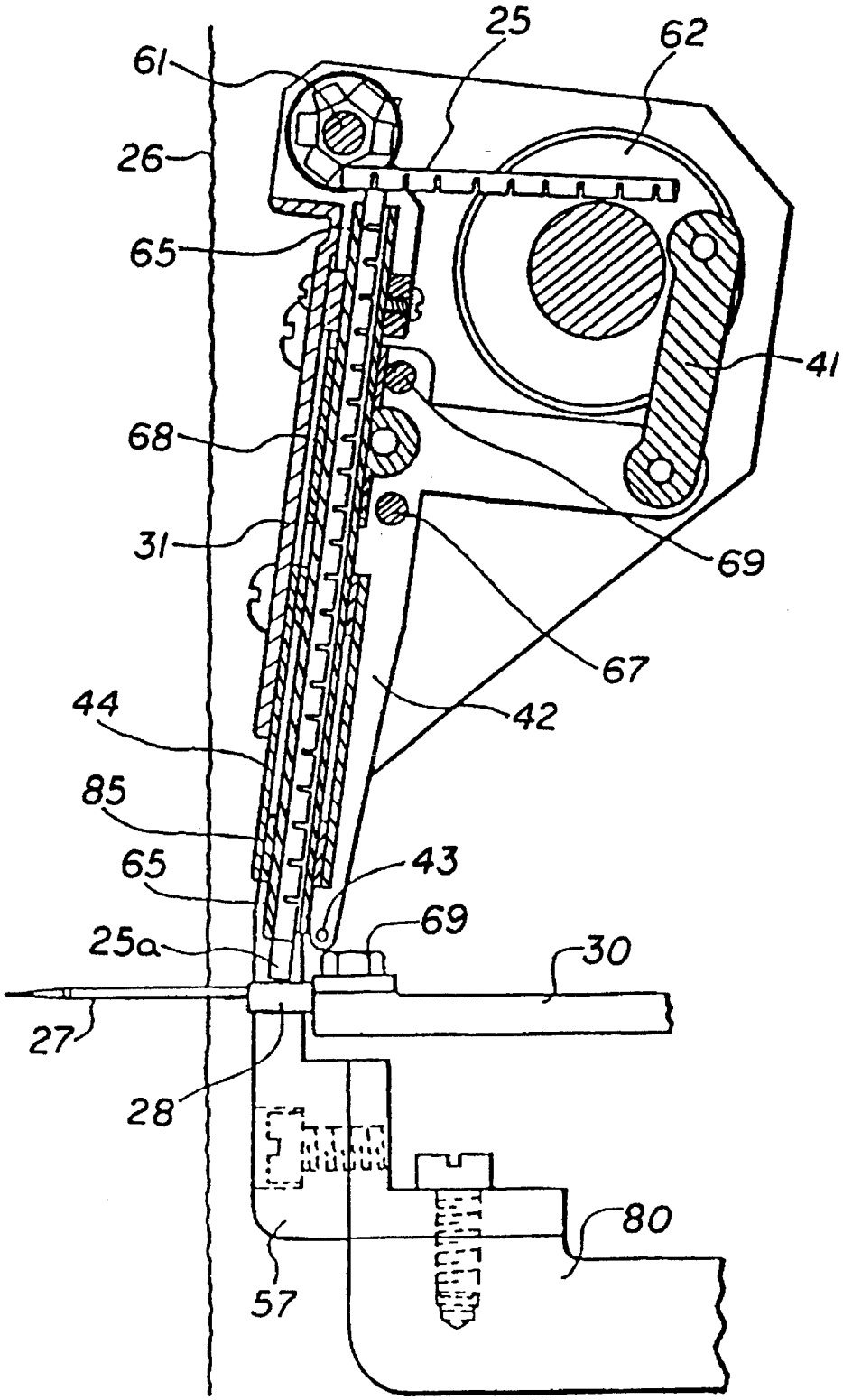
FIG. 22 shows a step of the operation of the apparatus shown in FIG. 14.

Front, top and side views of a second embodiment of the bead embroidering apparatus of the present invention are shown in FIGS. 14, 15 and 16, respectively. Like the previous embodiment described above, this second embodiment is mounted on a known bead embroidering apparatus. In this embodiment, as shown in FIG. 22, the fastening part 57 of the bracket 32 is fastened to a drill base 80 which is used to open embroidering holes in the cloth. A shaft 60 is rotatably mounted onto the bracket 32 via bearings 64. A shaft 61 is also mounted to the bracket 32, and the bead string 25 is wound around hexagonal rollers 61*a* which are mounted on this shaft 61.

A plate 31 is fastened to the brackets 32. Grooves are formed in this plate 31 at intervals corresponding to the spacing of the needles, and guide pipes 44 are spot-welded in these grooves as shown in FIG. 17. Bead string guide pipes 65 are inserted into the guide pipes 44 with sleeve bearings 85 interposed so that the bead string guide pipes 65 are free to slide. The bead strings 25 are inserted into these bead string guide pipes 65. FIG. 18 is a front view of the needle bar 30. The needle 27 and pushing part 28 are fastened to the needle bar 30 by a bolt.

As illustrated in FIG. 14, collars 62 are fastened to the shaft 60, and a lever 42 is connected to each of these collars 62 via a link 41. Two pins 66 and 67 are mounted on each lever 42 as shown in FIG. 16. The respective pins 66 and 67 engage with both ends of a pipe 68 which is fastened to each of the bead string guide pipes 65.

Figure 20:
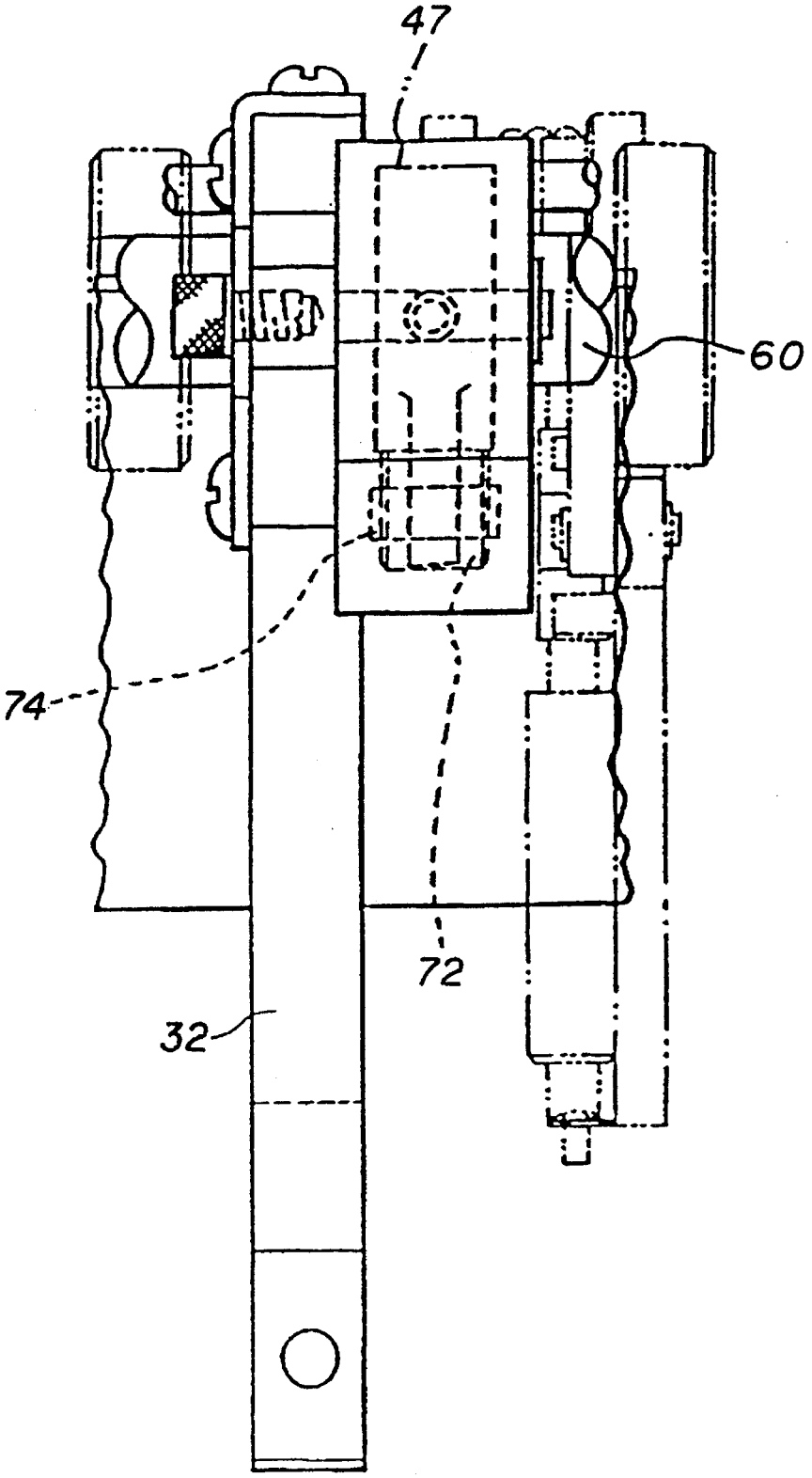
FIG. 20 is a front view thereof.

As shown in FIGS. 19 and 20, an air cylinder 71 is installed for each predetermined number of bead embroidering mechanisms 33. The piston rod 72 of each of these air cylinders 71 is connected to a link lever 73 via a shaft 74. This link lever 73 is fastened to the shaft 60. As a result, when the piston rod 72 of each air cylinder 71 performs a reciprocating motion as indicated by arrow I, the shaft 60 is caused to perform reciprocating rotary motion, as indicated by arrow J, via the corresponding link lever 73.

Figure 21:
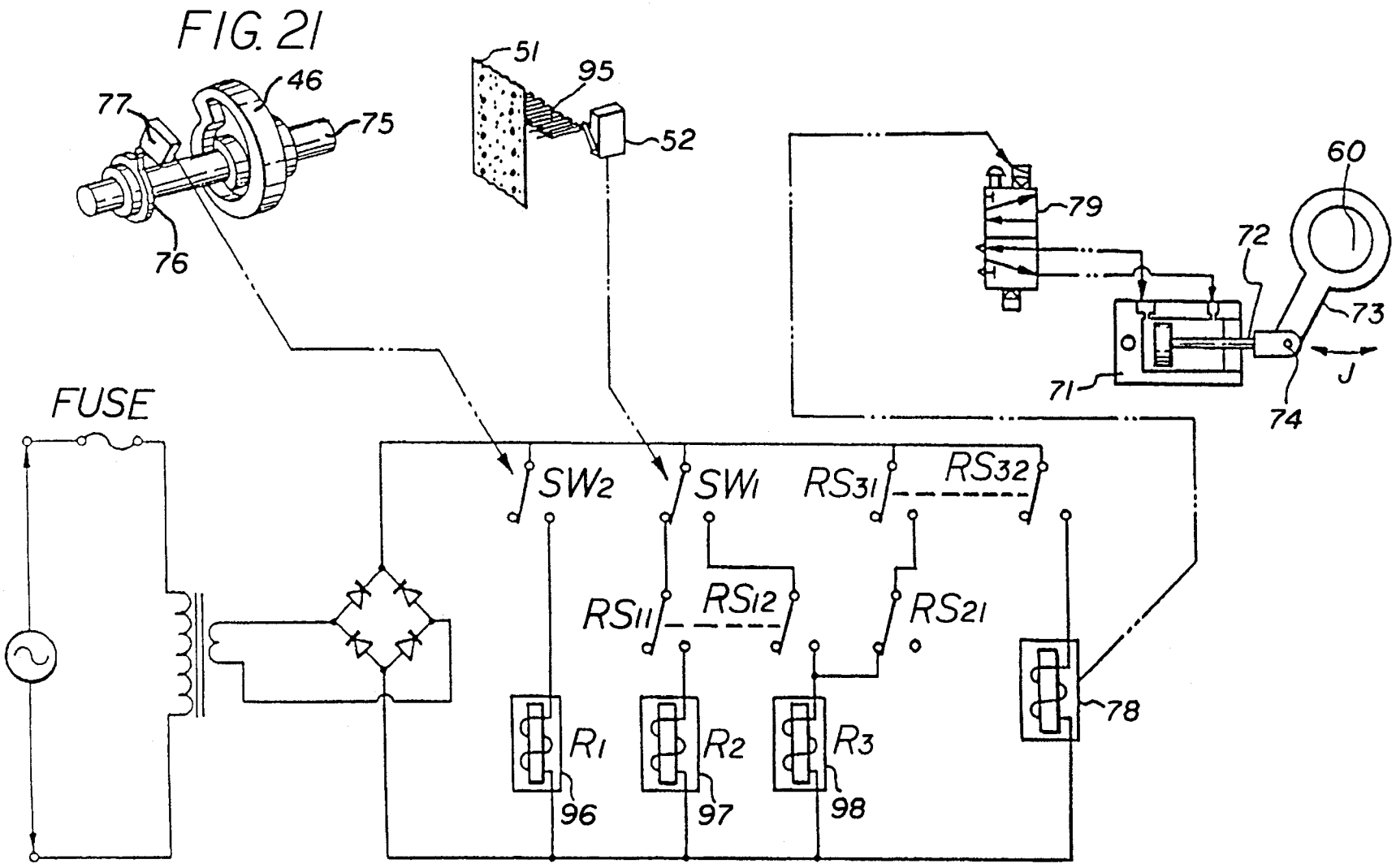
FIG. 21 shows the electrical control system used in the apparatus shown in FIG. 14.

FIG. 21 illustrates the structure of the electrical control system of the embodiment. A shaft 75 is used to drive the needle bar 30. The needle bar 30 performs a reciprocating motion in accordance with the shape of a cam 46 which is fastened to the shaft 75. A switch cam 76 is also fastened to the shaft 75, and a switch 77 is also installed so as to be actuated by this switch cam 76. When bead stitching positions are reached during the embroidery process using an embroidering thread, the switch 52 detects a bed embroidering "start" command via pins 95 in accordance with program data which is formed in the punch tape 51 beforehand. Here, when the switch 77 is actuated, a relay 96 is actuated so that the contact $RS_{11}$ and $RS_{12}$ are actuated. These act together with the previously actuated switch 52 so that a further relay 98 is actuated. As a result, the contacts $RS_{31}$ and $RS_{32}$ of the relay 98 are actuated. The contact $RS_{31}$ maintains the relay 98 in the actuated state and also actuates an air valve 79 via a solenoid 78. As a result, the air cylinder 71 is driven so that the shaft 60 is caused to rotate. When the shaft 75 enters its second revolution, the switch 52 has already been returned. When the switch 77 is again actuated by the cam 76, the relay 96 is actuated. Accordingly, the contacts $RS_{11}$ and $RS_{12}$ of the relay 96 are actuated so that the relay 97 is actuated. As a result of the actuation of this relay 97, the contact $RS_{21}$ of the relay 97 is actuated so that the self-maintenance of the relay 98 is released and relay 98 is no longer actuated. The contacts $RS_{31}$ and $RS_{32}$ of the relay 98 then return to their original positions, so that the air valve 79 is reset. As a result, the air cylinder 71 performs a reverse driving action so that the shaft 60 is caused to rotate in reverse.

Figure 23:
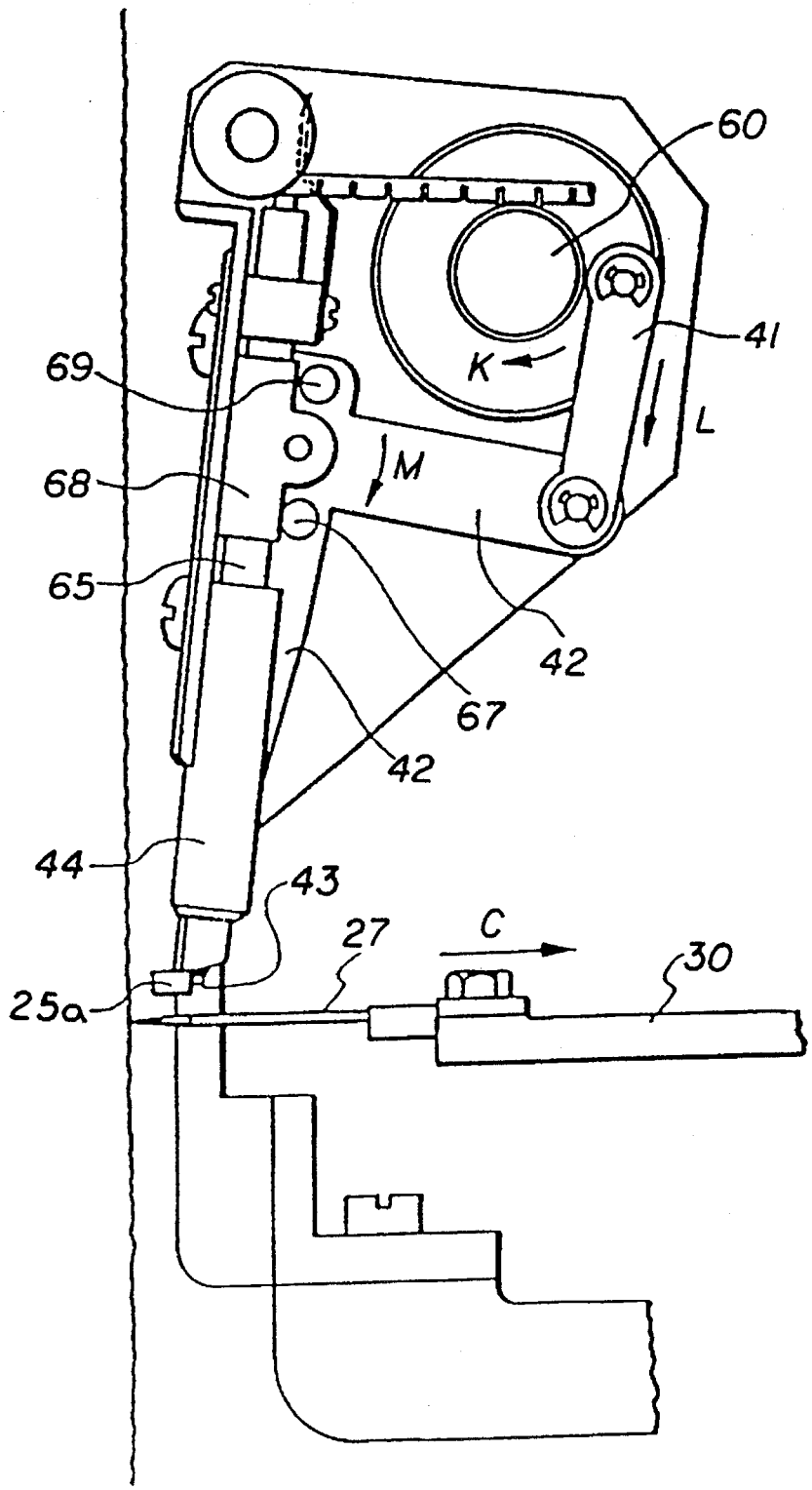
FIG. 23 shows the next step thereof.
Figure 24:
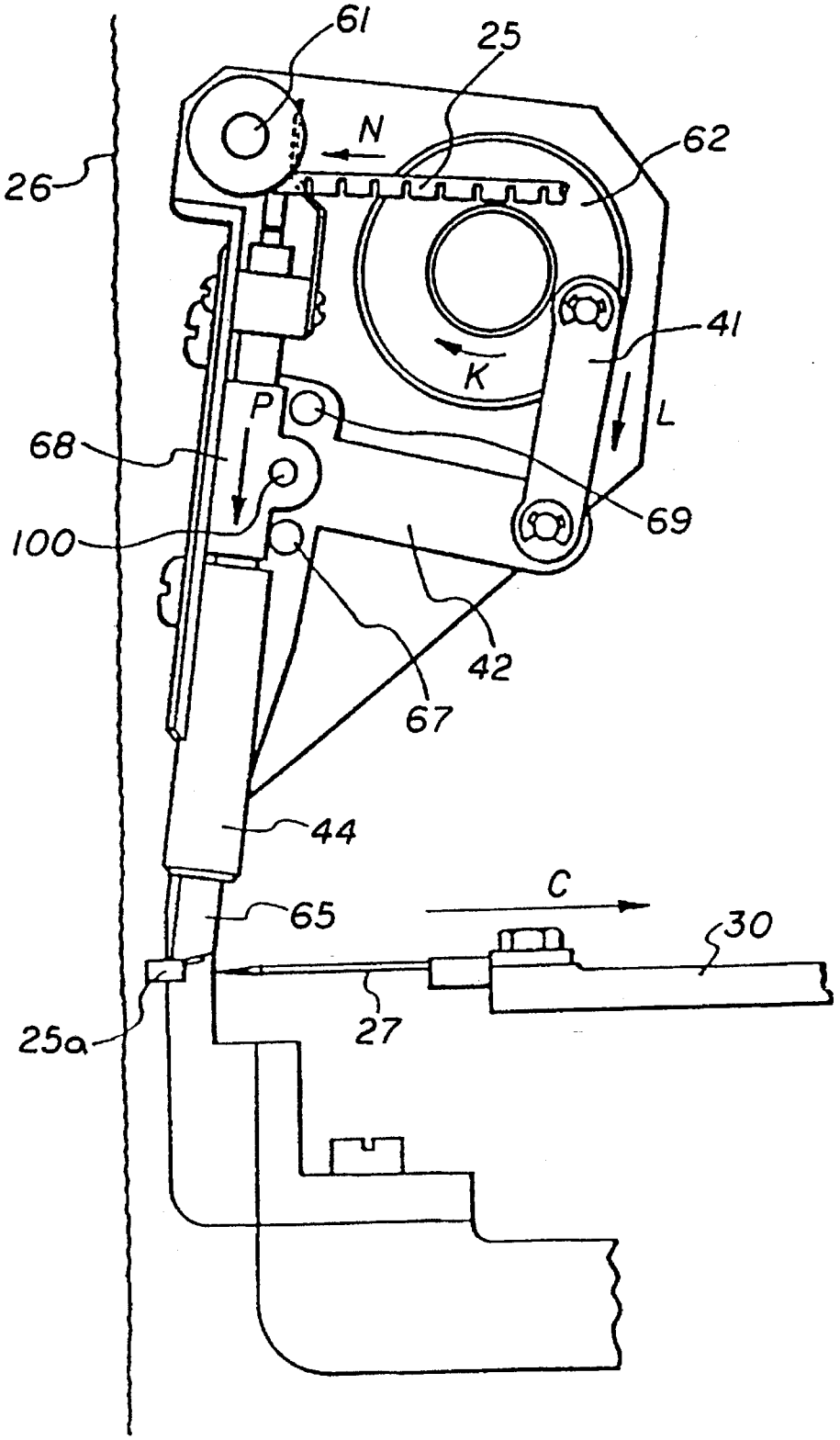
FIG. 24 shows the next, next step thereof.

The operation of the above-described embodiment is illustrated in sequence in FIGS. 22 through 27. The operation is substantially the same as that shown in FIG. 7 which is described based upon the flow chart of FIG. 1. FIG. 22 shows the state in which the bead string 25 is set. As described above, the bead strings 25 are loaded in the bead string guide pipes 65 with their connecting sections facing the cloth 26. The tip end bead **25*a* of each bead string 25 protrudes from the tip of the corresponding bead string guide pipe 65. In accordance with the bead embroidering "start" command, the shaft 60 is driven as indicated by arrow K, as shown in FIG. 23, in linkage with the withdrawing motion of the needle bar 30, so that the link 41 is pushed in the direction indicted by arrow L, thus causing the lever 42 to rotate in the direction indicated by arrow M. As a result, the pin 43 on the tip of the lever 42 bends the corresponding tip bead 25*a* toward the cloth. At this time, the pin 67 on the lever 42 contacts the pipe 68 provided on the corresponding bead string guide pipe 65, thus stopping the rotation of the lever 42. Afterward, when the collar 62 rotate further during the withdrawing action of the needle bar 30, the lever 42 moves together with the pipe 68 in a direction parallel to the movement of the link 41 as indicated by the arrow P in FIG. 24, since the lever 42 cannot rotate. Furthermore, the levers 42 are connected to the pipes 68 via supporting points 100 so that the levers 42 are free to rotate. As a result, the bead string guide pipes 65 slide through the guide pipes 44 toward the needles, so that the tip bead 25*a* of each bead string 25 is positioned in the reciprocating path of the corresponding needle 27. As a result of this action, each bead string 25** is fed by one pitch in the direction indicated by arrow N.

Figure 25:
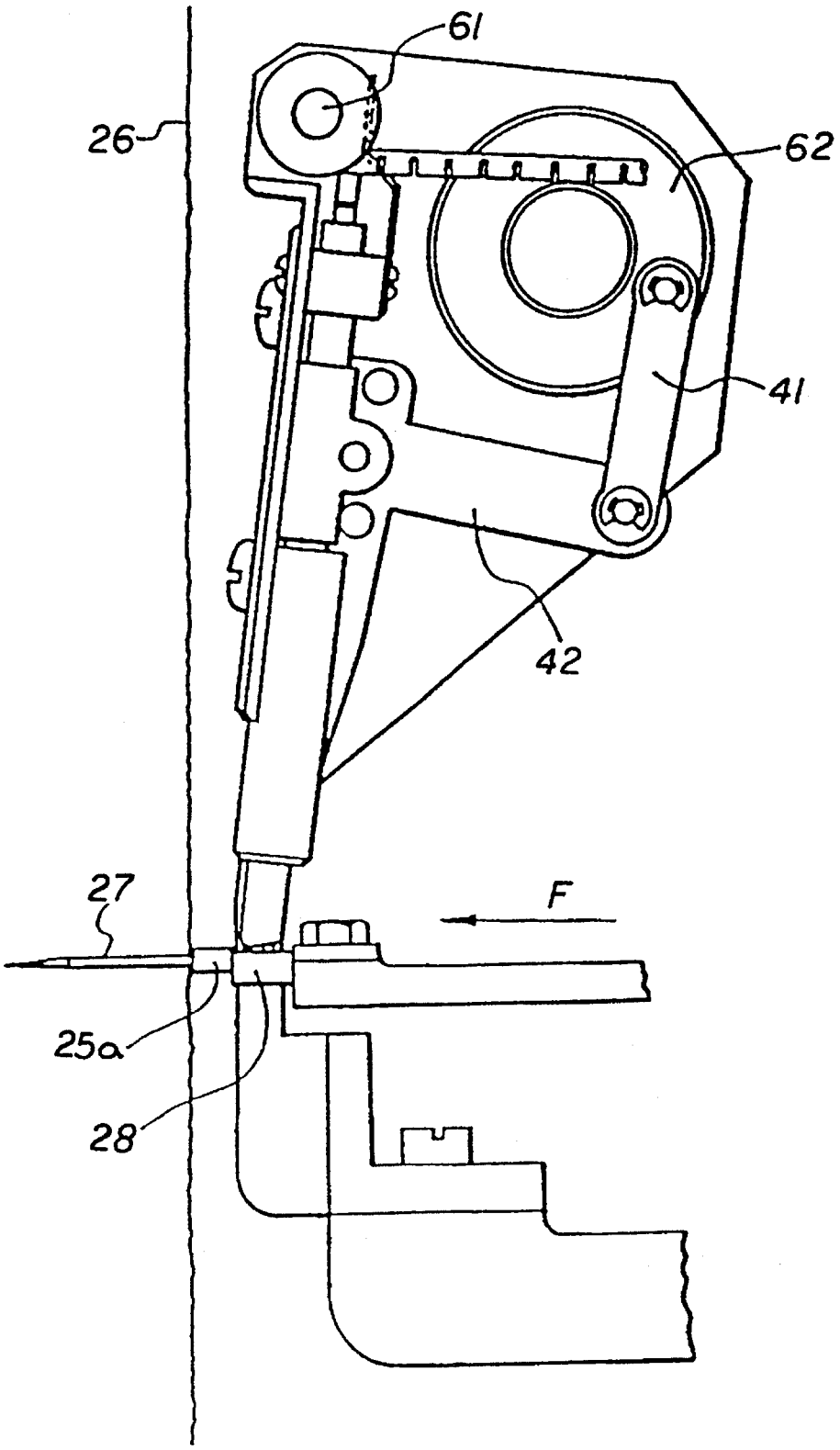
FIG. 25 shows the further step thereof.
Figure 26:
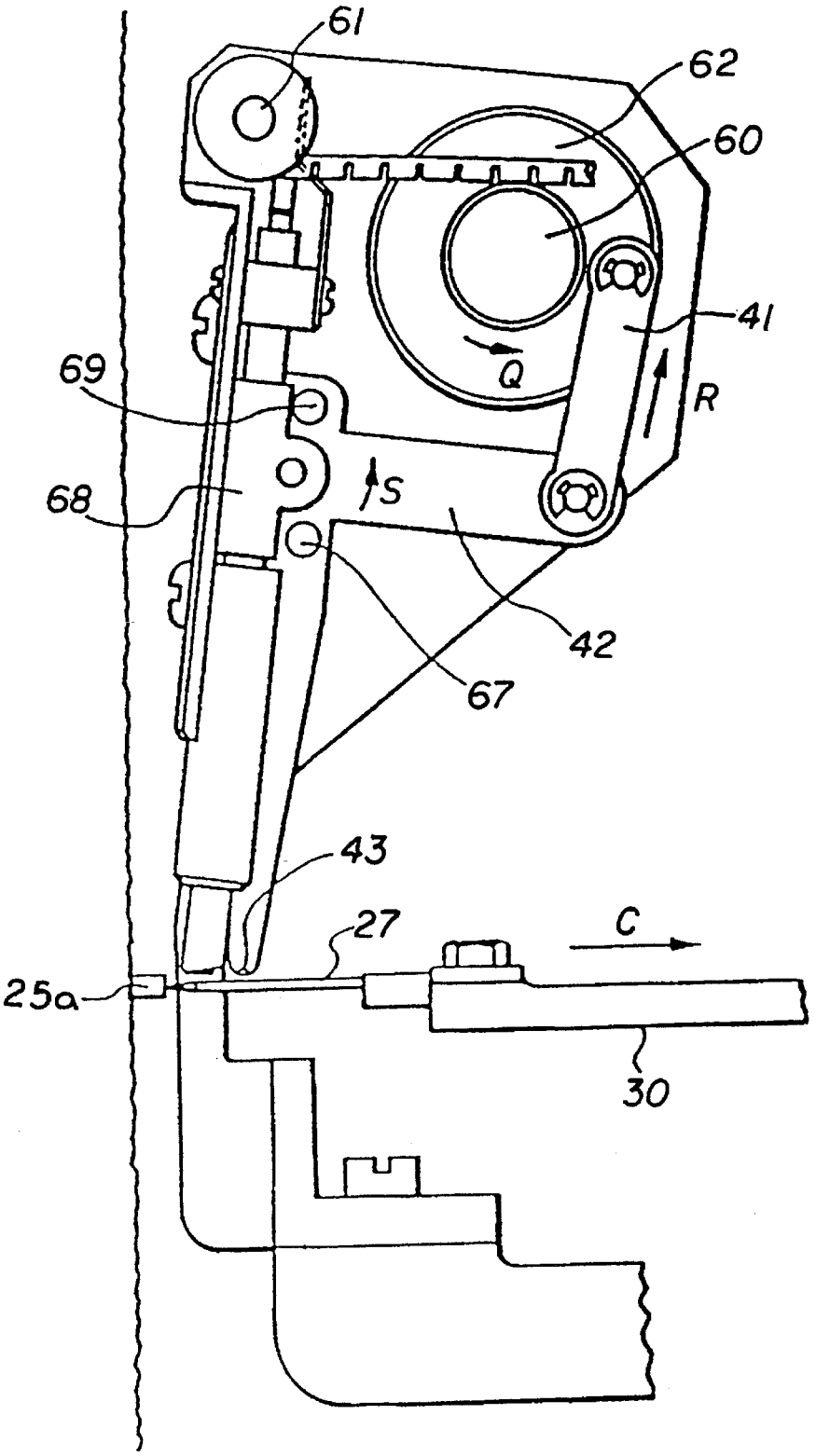
FIG. 26 shows still further step thereof.

Next, as shown in FIG. 25, the needle 27 advances and enters the tip beads **25*a*, and the pushing part 28 contacts the tip end bead 25*a* so that the bead 25*a* is separated from the bead string 25. Next, as shown in FIG. 26, the shaft 60 is caused to rotate reversely, as indicated by arrow Q, together with the withdrawing motion of the needles 27. Accordingly, the link 41 is drawn in the direction indicated by arrow R, so that the leer 42 is caused to rotate in the direction indicated by arrow S. As a result, the pin 43 at the tip of the lever 42 is caused to move away from the tip of the bead string guide pipe 65. Then, when the pin 69 on the lever 42 contacts the pipe 68 which is fastened to the corresponding bead string guide pipe 65, the rotation of the levers 42** is stopped.

Figure 27:
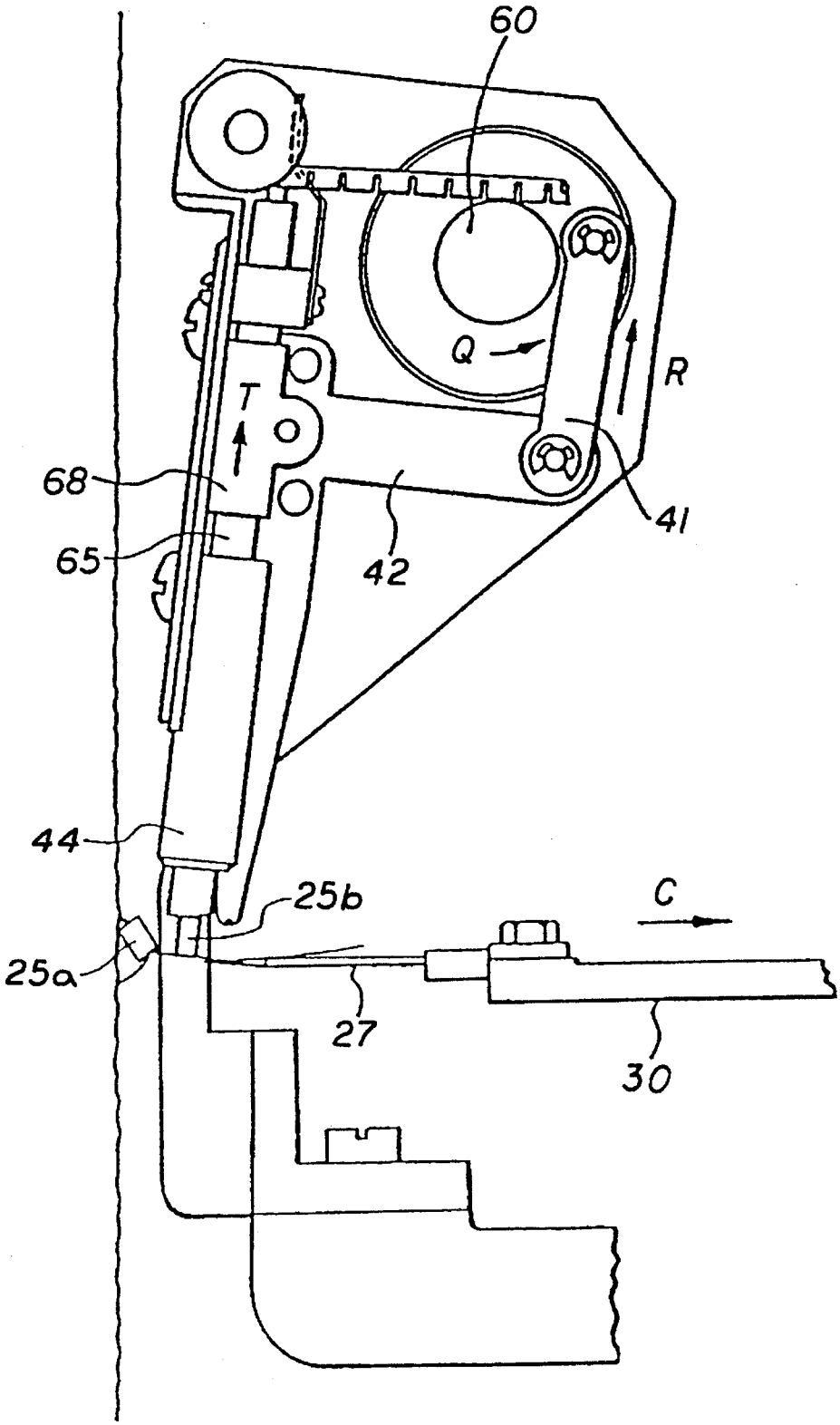
FIG. 27 shows the next further step thereof.

When the shaft 60 rotates even further, the bead string guide pipes 65 are drawn upward in the direction indicated by arrow T in FIG. 27 via the pipe 68 together with the motion of the link 41, since the lever 42 cannot rotate. As a result, the next bead **25*b* of the bed string 25 becomes the tip bead and is caused to protrude from the tip of the corresponding bead string guide pipe 65. Together with this operation, the bead stitching operation is performed as illustrated in FIG. 7**.

Figure 28:
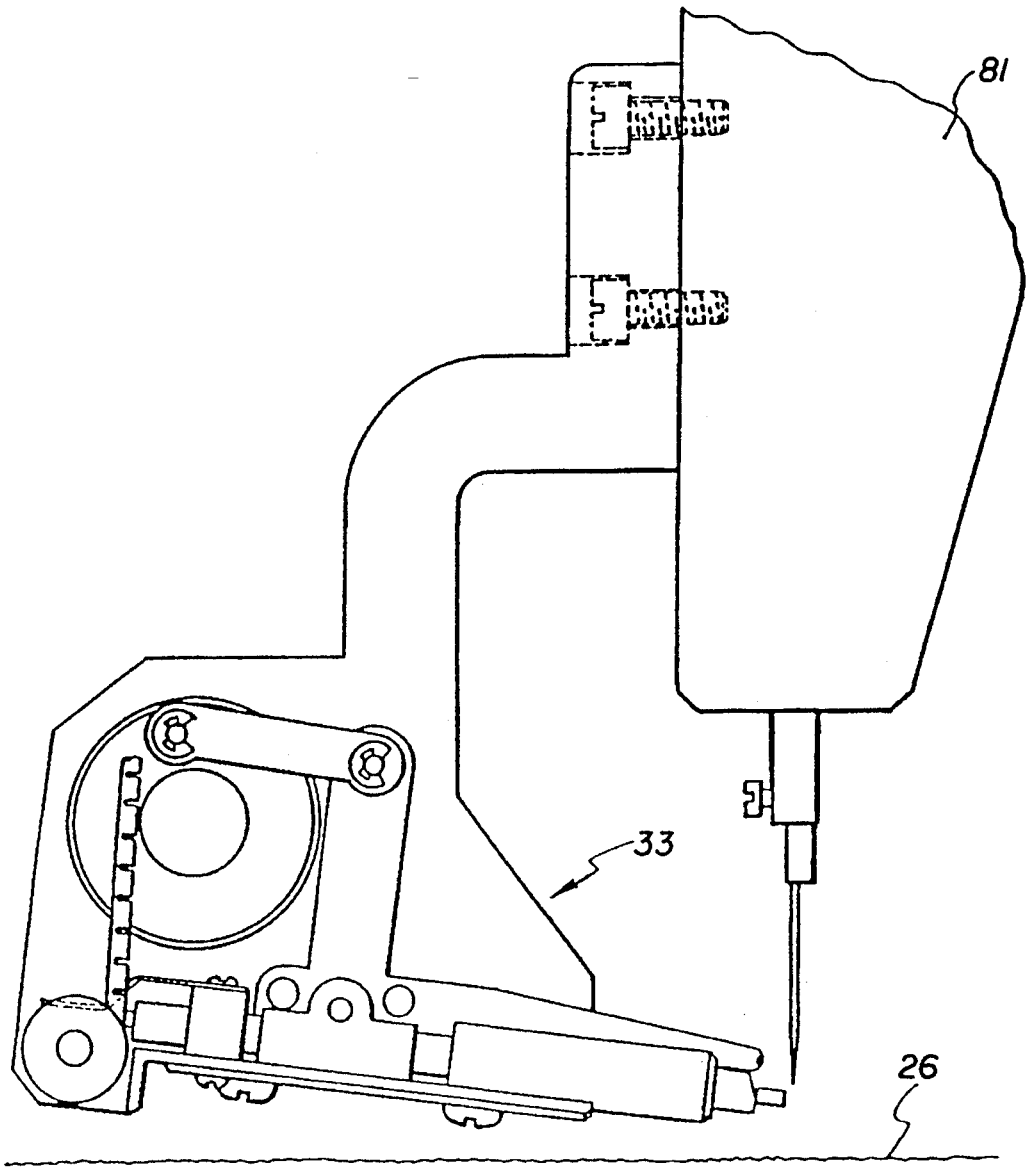
FIG. 28 is an explanatory diagram which illustrates third example of application of the present invention.

FIG. 28 illustrates third embodiment of the present invention. This embodiment illustrates a case in which bead embroidering mechanism or mechanisms 33 constructed according to the present invention are attached to a single-head type or multi-head type embroidering apparatus 81 which performs embroidery on a horizontally positioned cloth 26. By changing the shape of mounts of the brackets, it is possible to mount bead embroidering mechanisms of the present invention onto embroidering machines of various shapes and dimensions.

According to the present invention, as described above, cylindrical beads or angular tube shaped beads are automatically stitched at predetermined positions during an embroidering process utilizing an ordinary embroidering thread. Furthermore, bead embroidering mechanisms constructed according to the present invention can easily be attached to existing embroidering machines, thus making it possible to utilize the embroidering machines effectively and to improve the functioning of the machines. The use of the bead embroidering method and apparatus of the present invention makes it possible to manufacture desired stable bead embroidery patterns with high reliability compared to methods using conventional hand sewing techniques. Accordingly, the quality and the productivity can be greatly improved while lowering the cost. Furthermore, along with the improvement in quality and increase in productivity, there is a reduction in the time required for manufacturing. Accordingly, product delivery times can be stabilized and shortened even in areas remote from the manufacturing site. As a result, clothing fashions, which are subject to abrupt changes, can be dealt with timely.

I claim:

1. A method for embroidering beads (14) onto a cloth (26) comprising:

providing an embroidering apparatus equipped with at least one thread carrying needle (27) which performs a reciprocating motion relative to the surface of a cloth (26) to attach a thread stitch to said cloth (26);

providing at least one continuous bead string having multiple numbers of tube shaped beads (14, 16) each having an axial tube bore therethrough, said beads (14,16) of said continuous bead string interconnected via separable connecting sections, said beads (14,16) being provided sequentially wherein said axial tube bores of said beads (14,16) are aligned with each other in said at least one continuous bead string;

installing said at least one continuous bead string in said embroidering apparatus in an arrangement conductive to the respective sewing of said beads (14,16) to the surface of said at least one cloth (26);

repetitively engaging a tip bead (14,16) of said at least one continuous bead string with said thread carrying needle (27);

severing said at least one connecting section (15, 18) between said needle engaged tip bead (14, 16) and said at least one continuous bead string; and affixing said severed tip bead (14,16) to said cloth (26).

2. The method according to claim 1, wherein said engaging, severing and affixing steps of said method further comprise:

bending a tip bead (14,16) of said at least one continuous bead string about said connecting section (15,18);

feeding said at least one continuous bead string such that, following said bending and feeding steps, said axial tube bore of said tip bead (14, 16) of said at least one continuous bead string is positioned in the path of reciprocating motion of said at least one needle (27);

inserting said needle (26) into and through the axial bore of said tip bead (14,16);

forcibly advancing said tip bead (14,16) toward said cloth (26) to cause said connecting section (15,18) to break;

affixing a thread proximate a tip end of said tip bead (14,16) to said cloth (26);

withdrawing said needle (27) from said bead (14,16);

shifting said cloth (26) with respect to said needle (27) so that said separated bead orients properly on said cloth (26) surface; and sewing said thread proximate a tail end of said tip bead (14,16) to said cloth (26) after said tip bead (14,16) has oriented onto the cloth surface.

3. The method for embroidering beads (14) according to claim 1, wherein said at least one continuous bead string is initially formed by bonding beads to a belt-form material (15).

4. The method for embroidering beads (16) according to claim 1, wherein said at least one continuous bead string is formed by forming cross-sectional cut-outs (17) in a tube-form material with a portion of the tube-form material left intact as a connecting section (18) between successive beads (16).

5. A method for embroidering beads according to claim 1, wherein the method further includes forming said at least one continuous bead string by the steps of:

bending a long belt-form material (20) to form a tube-form material; and forming cross-sectional cut-outs (23) in said tube-form material to define individual beads (19,25) with a portion of the tube-form material left intact as a connecting section (18) between successive beads (19,25).

6. The method of embroidering beads (14) according to claim 2, wherein said at least one continuous bead string is initially formed by bonding beads to a belt-form material (15).

7. The method for embroidering beads (16) according to claim 2, wherein said at least one continuous bead string is formed by forming cross-sectional cut-outs (17) in a tube-form material with a portion of the tube-form material left intact as a connecting section (18) between successive beads (16).

8. The method for embroidering beads according to claim 2, wherein the method further includes forming said at least one continuous bead string by the steps of:

bending a long belt-form material (20) to form a tube-form material; and forming cross-sectional cut-outs (23) in said tube-form material to define individual beads (19,25) with a portion of the tube-form material left intact as a connecting section (18) between successive beads (19,25).

9. An embroidering apparatus, of the type equipped with needles (27) which perform a reciprocating motion relative to the surface of cloth (26), for embroidering beads (25) to the surface of cloth, said apparatus comprising:

continuous bead string advancing means (34,36) for providing a continuous string of interconnected tube shaped beads, each of said beads (25) having an axial tube bore therethrough;

means (40–44) for directing a tip bead (25) of said continuous bead string into alignment with the path of reciprocating motion of one of said needles (27);

tip bead bending means (40–43) for bending tip beads of said continuous bead string, to align said axial tube bore in said bead with the path of reciprocating motion of said needles (27) wherein said tip bead bending means is included in said means for directing;

means for severing (28) said tip bead (25) from said continuous bead string; and means for affixing said severed tip bead (25) in a properly oriented arrangement on said cloth (26).

10. The apparatus of claim 9 wherein said means for severing comprises a shoulder (28) on said needle (27), said shoulder (28) engaging said bead (25) upon advancement of said needle (27) to forcibly break a connecting section (18).

11. The apparatus of claim 9 wherein said means for affixing further comprising:

means for affixing (27,30,51) said thread proximate a tip end of said tip bead to said cloth;

means for withdrawing (27,30,51) said needle (27) from said severed tip bead;

means for shifting (51) said cloth (26) with respect to said needle (27) so that said severed tip bead is properly oriented on said cloth (26); and means for sewing (27,30,51) said thread proximate a tail end of said tip bead to said cloth (26) after said tip bead has been oriented onto a surface of said cloth (26).

12. An embroidering apparatus, of the type equipped with needles (27) which more along paths of reciprocating motion relative to the surface of cloth (26), for embroidering beads (25) to the surface of cloth, said apparatus comprising:

continuous bead string advancing means (34,36) for providing a continuous string of interconnected tube shaped beads, each of said beads (25) having an axial tube bore therethrough;

means (40–44) for directing a tip bead (25) of said continuous bead string into alignment with the path of reciprocating motion of one of said needles (27), said means for directing further including:

a guide (44) for guiding said continuous bead string toward said paths of reciprocating motion of said needles;

feeding means (36) for feeding said continuous bead string one bead at a time along said guide (44);

tip bead bending means (40–43) for bending tip beads of said continuous bead string, to align said axial tube bore in said bead with the path of reciprocating motion of said needles (27); and linking means (35, 40, 50–56) for linking said reciprocating motion of said needles (27) with said feeding means (35) and said tip bead bending means (40–43);

means for severing (28) said tip bead (25) from said continuous bead string; and means for affixing said severed tip bead (25) in a properly oriented arrangement on said cloth (26).

13. The apparatus of claim 12 wherein said means for severing comprises a shoulder (28) on said needle (27), said shoulder (28) engaging said bead (25) upon advancement of said needle (27) to forcibly break said connection section (18).

14. The apparatus of claim 12 wherein said means for affixing further comprising:

means for affixing (27,30,51) said thread proximate a tip end of said tip bead to said cloth;

means for withdrawing (27,30,51) said needle (27) from said separated bead;

means for shifting (51) said cloth (26) with respect to said needle (27) so that said separated bead is properly oriented on said cloth (26); and means for sewing (27,30,51) said thread proximate a tail end of said tip bead to said cloth (26) after said tip bead has oriented onto a surface of said cloth (26).

* * * * *